US012545385B2

(12) United States Patent
Dannenberg et al.

(10) Patent No.: US 12,545,385 B2
(45) Date of Patent: Feb. 10, 2026

(54) TRANSPORTABLE OUTBOARD MOTORS

(71) Applicant: Brunswick Corporation, Mettawa, IL (US)

(72) Inventors: Todd D. Dannenberg, Fond du Lac, WI (US); Matthew Z. Seta, Fond Du Lac, WI (US); Scott G. Ahlswede, Plymouth, WI (US); Gary D. Needham, Stillwater, OK (US); Robert A. Podell, Slinger, WI (US); Andrew J. Przybyl, Berlin, WI (US); Matthew S. Dawes, Stillwater, OK (US)

(73) Assignee: Brunswick Corporation, Mettawa, IL (US)

( * ) Notice: Subject to any disclaimer, the term of this patent is extended or adjusted under 35 U.S.C. 154(b) by 684 days.

(21) Appl. No.: 17/967,226

(22) Filed: Oct. 17, 2022

(65) Prior Publication Data

US 2024/0092468 A1 Mar. 21, 2024

Related U.S. Application Data

(63) Continuation-in-part of application No. 17/881,018, filed on Aug. 4, 2022, and a continuation-in-part of application No. 17/554,540, filed on Dec. 17, 2021, now Pat. No. 12,214,852.

(60) Provisional application No. 63/310,369, filed on Feb. 15, 2022.

(51) Int. Cl.

| | |
|---|---|
| ***B63H 20/10*** | (2006.01) |
| ***B63H 20/12*** | (2006.01) |
| ***B63H 20/36*** | (2006.01) |

(52) U.S. Cl.
CPC ..... *B63H 20/10* (2013.01); *B63H 20/12* (2013.01); *B63H 20/36* (2013.01)

(58) Field of Classification Search
CPC ..... B63H 20/10; B63H 20/12; B63H 20/36
See application file for complete search history.

(56) References Cited

U.S. PATENT DOCUMENTS

| | | | | |
|---|---|---|---|---|
| 1,854,196 A * | 4/1932 | Irgens | ..... | B63H 20/36 123/195 P |
| 2,019,136 A | 10/1935 | Johnson | | |
| 3,018,754 A | 1/1962 | Snyder et al. | | |

(Continued)

FOREIGN PATENT DOCUMENTS

| | | |
|---|---|---|
| AU | 2019100942 | 9/2019 |
| CA | 2367740 | 7/2002 |

(Continued)

OTHER PUBLICATIONS

Extended European Search Report for EP 23 156069.9, dated Jul. 10, 2023.

(Continued)

*Primary Examiner* — Stephen P Avila
(74) *Attorney, Agent, or Firm* — Andrus Intellectual Property Law, LLP

(57) ABSTRACT

A transportable outboard motor has a midsection and a tiller extending forwardly from the midsection. The tiller is pivotable about a lateral tilt axis into a downward tilt position in which the tiller is oriented transversely to the lateral and longitudinal directions. The tiller in the downward tilt position is configured to permit manual carrying of the transportable outboard motor.

20 Claims, 35 Drawing Sheets

(56) References Cited

U.S. PATENT DOCUMENTS 3,148,557 A * 9/1964 Shimanckas ..... B63H 20/14 74/378
3,693,576 A 9/1972 Driscoll
3,865,334 A 2/1975 Wair, Jr.
3,955,527 A 5/1976 Holtermann
3,961,595 A 6/1976 Meyer
D246,853 S 1/1978 Berchem
4,071,002 A 1/1978 Frahm
4,295,835 A 10/1981 Mapes et al.
4,331,431 A 5/1982 Estes
D272,357 S 1/1984 Hall et al.
4,447,214 A 5/1984 Henrich
4,496,326 A 1/1985 Boda
D295,867 S 5/1988 Walsh
4,800,854 A 1/1989 Boda et al.
4,838,820 A 6/1989 Boda et al.
4,878,468 A 11/1989 Boda et al.
4,897,061 A 1/1990 Koepsel et al.
4,911,665 A 3/1990 Hetzel
5,072,809 A 12/1991 Shibata
D323,508 S 1/1992 Hirshberg et al.
D332,265 S 1/1993 Osumi
D341,365 S 11/1993 Little et al.
5,277,634 A 1/1994 Calamia et al.
5,340,342 A 8/1994 Boda et al.
D352,723 S 11/1994 DeBraal et al.
5,378,178 A 1/1995 Haman
D359,290 S 6/1995 Takeuchi
5,509,836 A 4/1996 Ogasawara et al.
5,632,657 A 5/1997 Henderson
D387,775 S 12/1997 Iekura
D412,911 S 8/1999 Iekura
5,967,866 A 10/1999 Willows et al.
D418,519 S 1/2000 Iekura
D421,444 S 3/2000 Hatch et al.
D428,616 S 7/2000 Iekura
D438,493 S 3/2001 Mulliniks et al.
6,264,516 B1 7/2001 Mceathron et al.
D448,037 S 9/2001 Westimayer et al.
6,352,456 B1 3/2002 Jaszewski et al.
D457,166 S 5/2002 Burmeister et al.
D458,273 S 6/2002 Burmeister et al.
6,406,342 B1 6/2002 Walczak et al.
D460,465 S 7/2002 Williams
D460,972 S 7/2002 Osumi
D462,363 S 9/2002 Burmeister et al.
D463,447 S 9/2002 Osumi et al.
D463,448 S 9/2002 Osumi et al.
D463,449 S 9/2002 Osumi
D463,800 S 10/2002 Osumi
D466,907 S 12/2002 Ohsumi
6,494,431 B1 12/2002 McCoy
D470,154 S 2/2003 Burmeister et al.
6,524,148 B2 2/2003 Yoshigasaki et al.
D474,480 S 5/2003 Zebley, Jr. et al.
D474,784 S 5/2003 Sanschagrin et al.
6,558,213 B1 5/2003 McGowan
D478,597 S 8/2003 Zebley, Jr.
6,663,450 B1 12/2003 Walczak et al.
D485,847 S 1/2004 Sanschagrin et al.
D485,848 S 1/2004 Sanschagrin et al.
D486,500 S 2/2004 Okamoto
D489,380 S 5/2004 Ohsumi et al.
D495,345 S 8/2004 Farlow et al.
D495,716 S 9/2004 Sanschagrin et al.
D497,370 S 10/2004 Katoh
D498,485 S 11/2004 Kuwae
D498,764 S 11/2004 Sanschagrin et al.
D500,056 S 12/2004 DeYoung et al.
6,875,066 B2 4/2005 Wolaver
7,001,231 B1 2/2006 Halley et al.
D517,096 S 3/2006 Landers et al.
7,090,551 B1 8/2006 Lokken et al.
D527,737 S 9/2006 Iekura
D528,128 S 9/2006 Sanschagrin et al.
D528,563 S 9/2006 Sanschagrin et al.
D531,639 S 11/2006 Okamoto
D531,640 S 11/2006 Okamoto
D536,704 S 2/2007 Iekura
D537,838 S 3/2007 Iekura
7,210,973 B2 5/2007 Sanschagrin et al.
D549,240 S 8/2007 Okamoto
7,267,592 B1 9/2007 Ingebritson et al.
D560,050 S 1/2008 Tokach et al.
D565,607 S 4/2008 Moen et al.
D578,274 S 10/2008 Tokach et al.
D584,317 S 1/2009 Okamoto
D589,981 S 4/2009 Iekura
D611,062 S 3/2010 Okamoto
D611,063 S 3/2010 Okamoto
7,736,207 B2 6/2010 Vignau
D623,661 S 9/2010 Yamagishi et al.
D624,567 S 9/2010 Kelley
D626,975 S 11/2010 Ryczek et al.
D629,818 S 12/2010 Rummer et al.
D635,154 S 3/2011 Rummer et al.
7,895,959 B1 3/2011 Angel et al.
D635,586 S 4/2011 Okamoto
D643,440 S 8/2011 Dannenberg et al.
D655,320 S 3/2012 Hiraoka et al.
D657,400 S 4/2012 Loew
D660,323 S 5/2012 Hiraoka et al.
D660,614 S 5/2012 Palmeiri
D663,321 S 7/2012 Okamoto
8,257,122 B1 9/2012 Holley
8,651,906 B1 2/2014 Morton
D706,313 S 6/2014 Higashikawa et al.
D707,729 S 6/2014 Jackson et al.
D708,233 S 7/2014 Furuki et al.
D709,918 S 7/2014 Jones, Sr.
D712,931 S 9/2014 Matsumoto
D714,345 S 9/2014 Petit et al.
D715,333 S 10/2014 Jacobsthal et al.
D716,846 S 11/2014 Carter et al.
D727,969 S 4/2015 Okamoto
D728,640 S 5/2015 Turner et al.
9,039,469 B1 5/2015 Calamia et al.
9,073,616 B1 7/2015 Wiegele et al.
D740,858 S 10/2015 Dannenberg et al.
9,180,950 B1 11/2015 Davenport et al.
9,205,906 B1 12/2015 Eichinger
9,216,805 B1 12/2015 Amerling et al.
D757,126 S 5/2016 Vaninetti et al.
9,359,059 B1 6/2016 Scherer, III et al.
9,359,981 B1 6/2016 Waisanen et al.
9,376,194 B1 6/2016 Jensen et al.
9,481,438 B1 11/2016 Tuchscherer
9,580,947 B1 2/2017 Amerling et al.
9,587,601 B1 3/2017 Ochiai
D791,189 S 7/2017 Scherer, III et al.
9,701,383 B1 7/2017 Stuber et al.
D794,078 S 8/2017 Vaninetti
D794,079 S 8/2017 Vaninetti et al.
9,764,813 B1 9/2017 Zarembka et al.
9,783,278 B1 10/2017 Dannenberg et al.
9,789,945 B1 10/2017 Vaninetti et al.
9,840,316 B1 12/2017 Jaszewski
D806,752 S 1/2018 Vaninetti et al.
D807,920 S 1/2018 Vaninetti
D809,017 S 1/2018 Noda et al.
9,926,064 B1 3/2018 Tuchscherer
D816,716 S 5/2018 Abellera et al.
D832,472 S 10/2018 Davis et al.
D834,617 S 11/2018 Zin et al.
D834,618 S 11/2018 Zin et al.
D835,675 S 12/2018 Nakaura et al.
D842,504 S 3/2019 Davis et al.
10,246,173 B1 4/2019 Ingebritson
D852,230 S 6/2019 Zin et al.
D852,848 S 7/2019 Zin et al.
D852,849 S 7/2019 Zin et al.
D852,850 S 7/2019 Zin et al.
D859,469 S 9/2019 Zin et al.
10,696,367 B1 6/2020 Ingebritson et al.

(56) References Cited

U.S. PATENT DOCUMENTS

| | | | |
|---|---|---|---|
| 10,787,236 | B1 | 9/2020 | Erickson |
| 10,940,917 | B2 | 3/2021 | Montague et al. |
| D917,565 | S | 4/2021 | Vaninetti et al. |
| 10,981,639 | B2 | 4/2021 | Kimpara et al. |
| 11,084,563 | B1 | 8/2021 | Pielow et al. |
| 11,097,824 | B1 | 8/2021 | Anderson, Jr. |
| 11,097,826 | B1 | 8/2021 | Dannenberg et al. |
| 11,186,352 | B1 | 11/2021 | Erickson et al. |
| 2003/0024456 | A1 | 2/2003 | Swetish |
| 2003/0194927 | A1 | 10/2003 | Sanschagrin et al. |
| 2003/0232548 | A1 | 12/2003 | Alby et al. |
| 2006/0172631 | A1 | 8/2006 | Kameoka |
| 2007/0042652 | A1 | 2/2007 | Kitsu et al. |
| 2009/0075534 | A1 | 3/2009 | Wiatrowski et al. |
| 2010/0147257 | A1 | 6/2010 | Yazaki et al. |
| 2013/0280970 | A1 | 10/2013 | Clarkson et al. |
| 2014/0057508 | A1 | 2/2014 | Litjens et al. |
| 2016/0023740 | A1 | 1/2016 | Skrzypchak et al. |
| 2017/0306830 | A1 | 10/2017 | Bruestle et al. |

FOREIGN PATENT DOCUMENTS

| | | | |
|---|---|---|---|
| CA | 2453466 | * | 6/2004 |
| EP | 1101696 | | 5/2001 |
| EP | 3326903 | | 4/2019 |
| EP | 4155191 | A1 | 3/2023 |
| JP | S60 38293 | | 2/1985 |
| JP | 2002211489 | A | 7/2002 |
| JP | 2010058770 | A | 3/2010 |
| JP | 2011-213215 | | 10/2011 |
| JP | 2013-173423 | | 9/2013 |
| JP | 5604939 | | 10/2014 |
| WO | 2004-035381 | | 4/2004 |
| WO | 2007097057 | A1 | 8/2007 |

OTHER PUBLICATIONS

Extended European Search Report issued in EP Application No. 22211031.4, dated May 17, 2023.

Fergus, et al., Unpublished U.S. Appl. No. 17/487,116, filed Sep. 2021.

Jaszewski, et al., Unpublished U.S. Appl. No. 17/585,214, filed Jan. 2022.

Extended European Search Report issued in EP Application No. 22908264.9, dated Jan. 30, 2025.

Extended European Search Report issued in EP Application No. 22908263.1, dated Feb. 3, 2025.

International Search Report and the Written Opinion for Corresponding PCT Application No. PCT/US2022/052380, dated Apr. 24, 2023.

* cited by examiner

TRANSPORTABLE OUTBOARD MOTORS

CROSS-REFERENCE TO RELATED APPLICATIONS

The present application is a continuation-in-part which claims the benefit of and priority to U.S. patent application Ser. No. 17/554,540, filed Dec. 17, 2021 and U.S. patent application Ser. No. 17/881,018, filed Aug. 4, 2022, which '018 application claims the benefit of and priority to U.S. Provisional Patent Application Ser. No. 63/310,369, filed Feb. 15, 2022. All of the above-listed parent applications are hereby incorporated by reference herein in entirety.

FIELD

The present disclosure relates to outboard motors and particularly to outboard motors which are transportable.

BACKGROUND

The following U.S. patents and patent applications are incorporated herein by reference:

U.S. Pat. No. 11,097,824 discloses an apparatus for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

U.S. Pat. No. 11,186,352 discloses a tiller system for steering a marine propulsion device. The tiller system includes a tiller arm rotatably coupled to the marine propulsion device. The tiller arm is rotatable from a down position to an up position through a plurality of lock positions therebetween. A toothed member is coupled to one of the tiller arm and the marine propulsion device. The toothed member defines a plurality of teeth corresponding to the plurality of lock positions for the tiller arm. A pawl is coupled to another of the tiller arm and the marine propulsion device, where the pawl engages with the plurality of teeth to prevent the tiller arm from rotating downwardly through the plurality of lock positions.

U.S. Pat. No. 11,097,826 discloses a tiller for an outboard marine drive including a tiller body that is elongated along a tiller axis between a fixed end connected to an outboard marine drive and a distal end. A lanyard switch on the tiller body is configured to prevent operation of the outboard marine drive when a lanyard clip is not attached to the lanyard switch. A controller is configured to identify that an operator has provided user input to start the outboard marine drive and that the lanyard clip is not connected to the lanyard switch. The controller then generates a lanyard error alert identifying that the lanyard clip is not connected to the lanyard switch.

U.S. Pat. No. 10,787,236 discloses a tiller system for steering an outboard motor. The tiller system includes a tiller arm that is rotatably coupled to the outboard motor. The tiller arm is rotatable from a down position to an up position through a plurality of lock positions therebetween. A tilt lock system is coupled between the tiller arm and the outboard motor and is configured to be activated and deactivated. When activated, the tilt lock system prevents the tiller arm from rotating downwardly through each of the plurality of lock positions. The tiller arm is further rotatable into an unlock position, whereby rotating the tiller arm into the unlock position automatically deactivates the tilt lock system such that the tiller arm is freely rotatable downwardly through the plurality of lock positions.

U.S. Pat. No. 10,696,367 discloses a tiller for an outboard motor has a throttle grip which is manually rotatable through first and second ranges of motion into and between an idle position in which the outboard motor is controlled at an idle speed, and first and second open-throttle positions, respectively, in which the outboard motor is controlled at an above-idle speed. A throttle shaft is coupled to the throttle grip and is configured so that rotation of the throttle grip causes rotation of the throttle shaft, which changes a throttle position of a throttle of the outboard motor. A rotation direction switching mechanism is manually position-able into a first position in which rotation of the throttle grip through the first range of motion controls the throttle of the outboard motor and alternately manually position-able into a second position in which rotation of the throttle grip through the second range of motion controls the throttle position.

U.S. Pat. No. 10,246,173 discloses a tiller for an outboard motor having a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position. The interlock mechanism is further configured to permit a shift change into the neutral gear regardless of where the throttle is positioned.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left-handed) range of motion from an idle position in which the outboard motor is controlled at idle speed to first (left-handed) wide open throttle position in which the outboard motor is controlled at wide open throttle speed and alternately through a second (right handed) range of motion from the idle position to a second (right-handed) wide open throttle position in which the outboard motor is controlled at wide open throttle speed.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along an axial direction, along a vertical direction which is perpendicular to the axial direction, and along a horizontal direction which is perpendicular to the axial direction and perpendicular to the vertical direction. The inner wedges of the first and second mounts both have a non-circular shape when viewed in a cross-section taken perpendicular to the axial direction. The non-circular shape comprises a first outer surface which extends laterally at an angle to the horizontal and vertical directions. The non-circular shape comprises a second outer surface which extends laterally at a different, second angle to the horizontal and vertical directions. A method is for making the mounting arrangement.

U.S. patent application Ser. No. 17/487,116 discloses an outboard motor including a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

U.S. patent application Ser. No. 17/585,214 discloses a marine drive is for propelling a marine vessel. The marine drive has a propulsor configured to generate a thrust force in a body of water; a battery that powers the propulsor; and a supporting frame which supports the marine drive relative to marine vessel. The supporting frame has a monolithic body defining a frame interior, and further has a support leg extending downwardly from the monolithic body and a steering arm extending forwardly from monolithic body. A cowling is fixed to the supporting frame via at least one hidden fastener that extends from the frame interior, through the supporting frame, and into engagement with the cowl body, wherein hidden fastener being accessible during installation.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A transportable outboard motor extends from top to bottom in an axial direction, from side to side in a lateral direction which is perpendicular to the axial direction, and from front to rear in a longitudinal direction which is perpendicular to the axial direction and perpendicular to the lateral direction. The transportable outboard motor has a midsection located between the top and the bottom, and a tiller extending forwardly from the midsection. The tiller is pivotable about a lateral tilt axis into a downward tilt position in which the tiller is oriented transversely to the lateral and longitudinal directions, wherein the tiller in the downward tilt position facilitates manual carrying of the transportable outboard motor. In non-limiting examples, the tiller is coupled to the steering arm and pivotable about the lateral tilt axis relative to the steering arm into a straightforward position in which the tiller is generally parallel to the steering arm and alternately into the downward tilt position in which the tiller is oriented generally transversely to the steering arm.

In non-limiting examples, a tilt mechanism is movable into an engaged position in which the tiller is locked in the downward tilt position and a disengaged position in which the tiller is movable out of the downward tilt position. The tilt mechanism comprises a tilt bracket coupled to a first one of the midsection of the transportable outboard motor and the tiller and a pawl coupled to a second one of the midsection of the transportable outboard motor and the tiller. The tilt mechanism is movable into an engaged position in which the pawl engages the tilt bracket to retain the tiller arm in the downward tilt position and alternately into a disengaged position in which the pawl is disengaged from the tilt bracket so that that the tiller is freely movable about the tilt axis relative to the midsection. A ratchet wheel has an outer radius with a recess corresponding to the downward tilt position, wherein the pawl ratchets across the ratchet wheel and engages with the recess when the tiller is pivoted downwardly about the lateral tilt axis.

In non-limiting examples, the transportable outboard motor has a cowling and an anti-ventilation plate located below the midsection and extending rearwardly from the transportable outboard motor. The anti-ventilation plate together with the cowling supports a remainder of the transportable outboard motor above a ground surface in a rear laydown position. The anti-ventilation plate comprises a rear edge with laterally outer rear support members, which together with the rear of the cowling form a rear tripod which supports the transportable outboard motor in the rear laydown position.

BRIEF DESCRIPTION OF THE DRAWINGS

Examples are described with reference to the following drawing figures. The same numbers are used throughout to reference like features and components.

DETAILED DESCRIPTION

Figure 1:
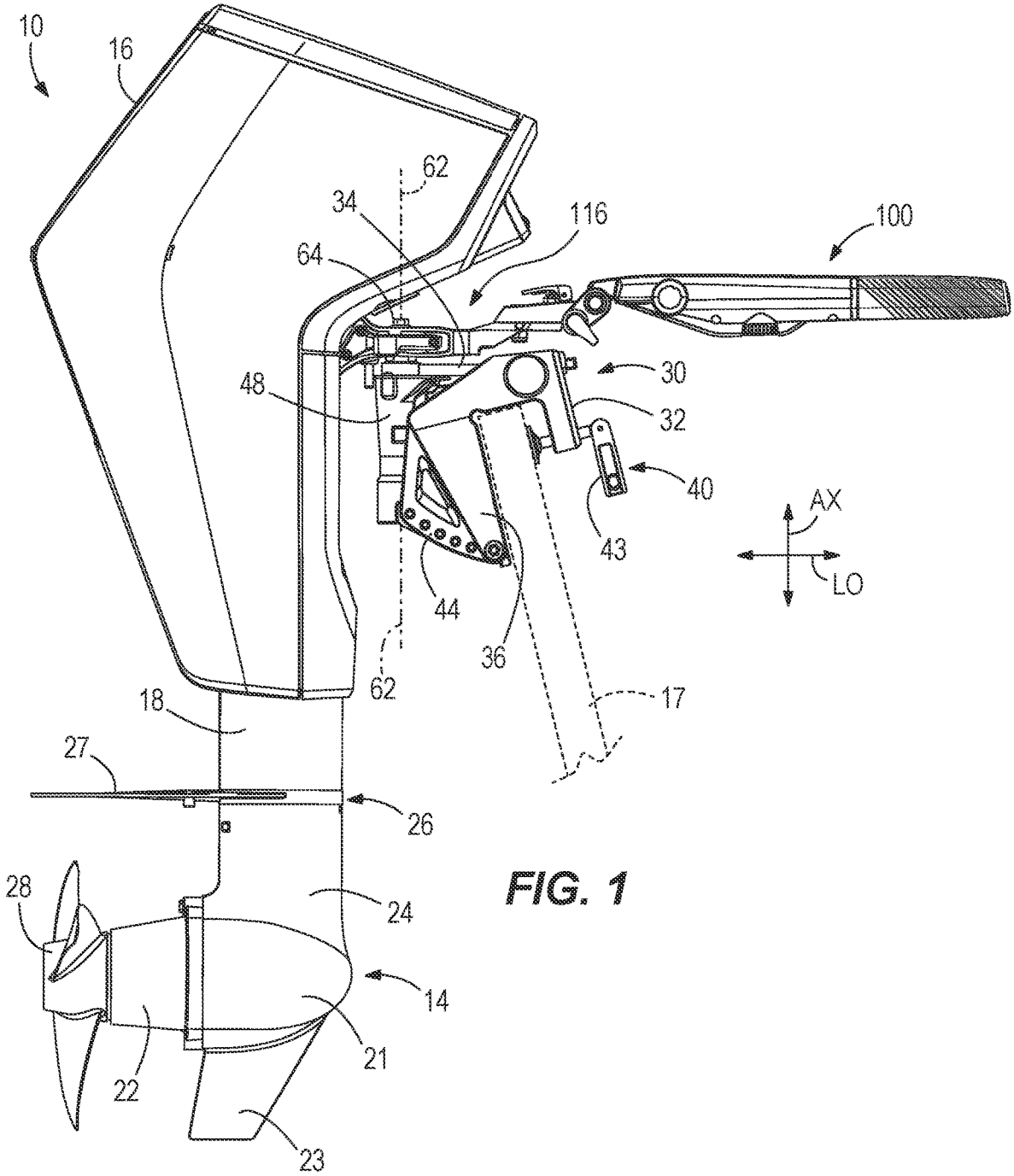
FIG. 1 is a side view of an outboard motor supported on the transom of a marine vessel by an transom bracket with a tiller in a horizontal tilt position according to the present disclosure.
Figure 2:
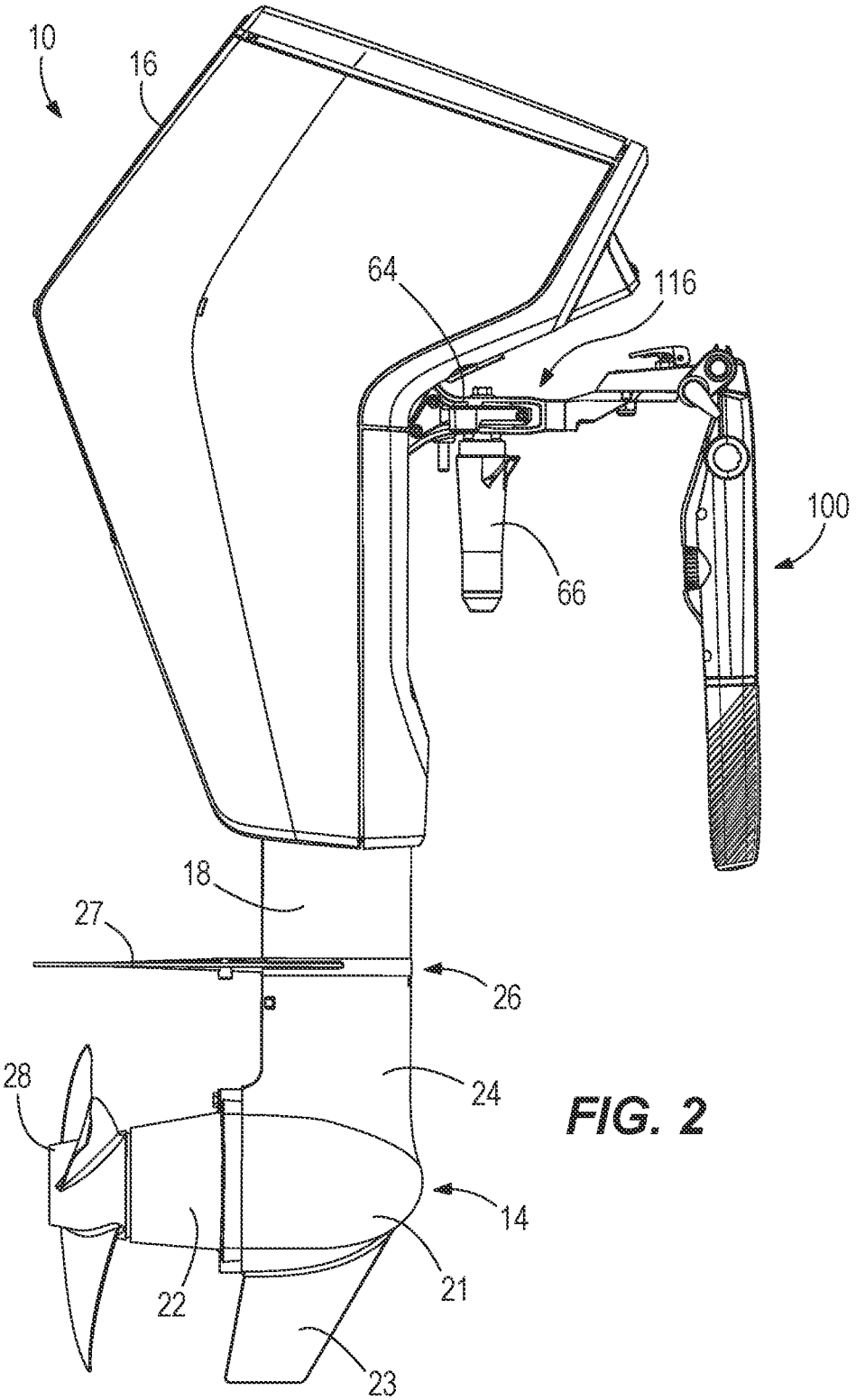
FIG. 2 a side view of the outboard motor of FIG. 1, with the tiller in a downward tilt position.
Figure 34:
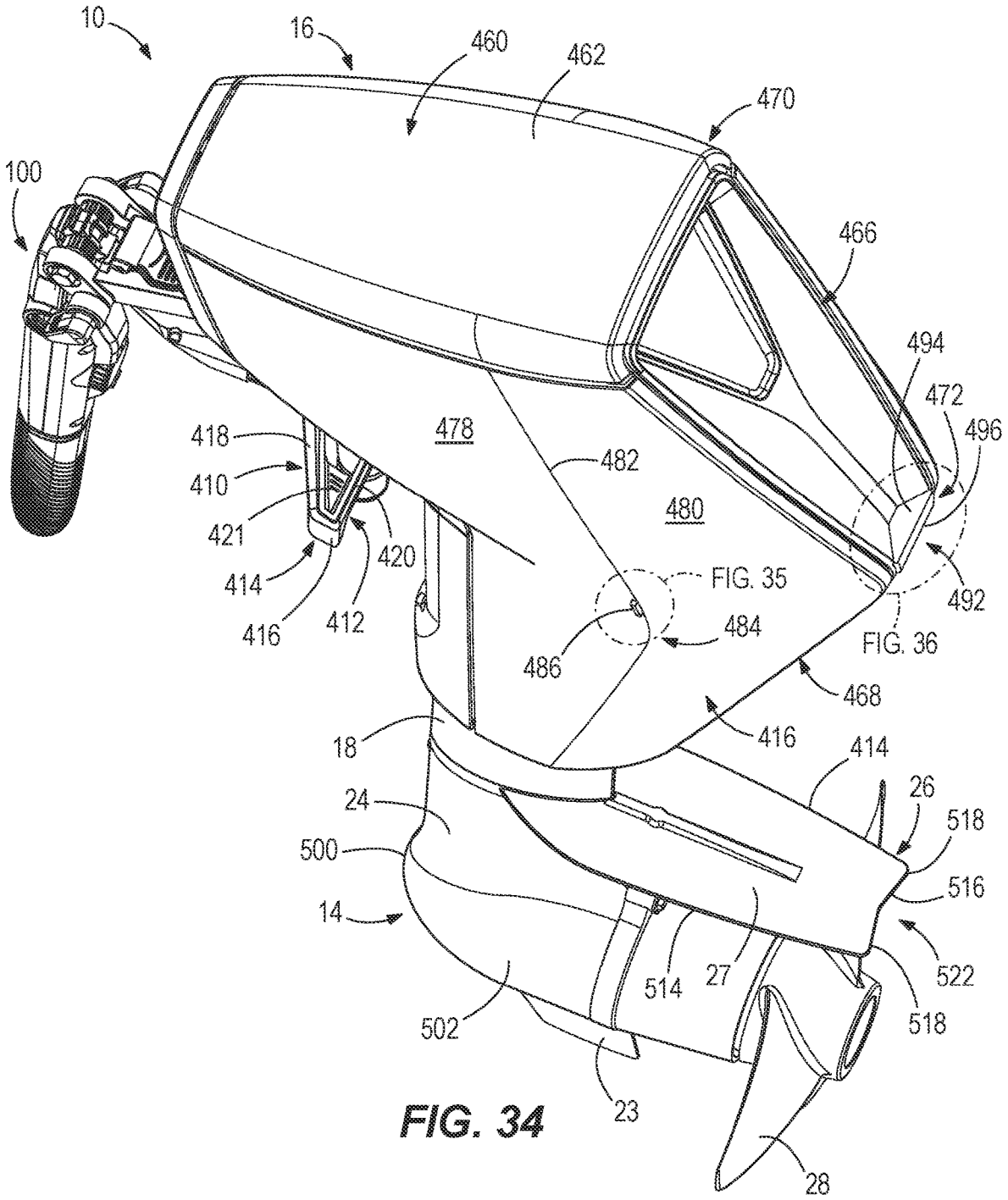
FIG. 34 is a side perspective view looking down at the outboard motor.

FIGS. 1 and 2 depict a marine drive for propelling a marine vessel in a body of water, which in the illustrated example is an outboard motor 10. The outboard motor 10 extends from top to bottom in an axial direction AX, from front to back in a longitudinal direction LO which is perpendicular to the axial direction AX, and from side to opposite side in a lateral direction LA (see e.g., FIG. 34) which is perpendicular to the axial direction AX and perpendicular to the longitudinal direction LO. The outboard motor 10 includes a supporting frame (not shown) for rigidly supporting the various components of the outboard motor 10 with respect to the marine vessel and a gearcase 14 secured to the supporting frame. A cowling 16 is fixed to and surrounds most or all of the supporting frame, as further disclosed in U.S. patent application Ser. No. 17/585,214, the disclosure of which is hereby incorporated herein by reference in entirety. The cowling 16 defines a cowling interior in which a portion of the supporting frame is enclosed and various components of the outboard motor 10 are disposed. It should be understood that the various components described above are exemplary and could vary from what is shown.

The outboard motor 10 generally includes an extension leg 18 which is coupled to the supporting frame and extends downwardly to a gearcase 14. The gearcase 14 has a front housing portion 21 and a rear housing portion 22 that are mated together and define a watertight lower housing cavity. The front housing portion 21 has a nosecone with a smooth outer surface which transitions to an upwardly extending stem 24 and a downwardly extending skeg 23. An anti-ventilation plate 26 is positioned between the extension leg 18 and the stem 24 and includes a flat tail 27 that extends rearwardly from the extension leg 18. A conventional propulsor 28 is mounted on the outer end of a propulsor shaft extending from the gearcase 14 such that rotation of the propulsor shaft causes rotation of the propulsor 28, which in turn generates a thrust force for propelling the marine vessel in water. The type and configuration of the propulsor can vary, and for example can include one or more propellers, impellers, and/or the like.

With continued reference to FIGS. 1 and 2, the outboard motor 10 is coupled to the transom 17 of a marine vessel by a transom bracket assembly 30, which in the illustrated example includes a transom bracket 32 fixed to the transom 17 and a swivel bracket 34 pivotably coupled to the transom bracket 32. The transom bracket 32 has a pair of C-shaped arms 36 which fit over the top of the transom 17 and a pair of threaded, plunger-style clamps 40 which clamp the C-shaped arms 36 to the transom 17. Rotation of handles 43 in one direction clamps the transom 17 between the C-shaped arms 36 and plunger-style clamps 40. Rotation of the handles 43 in the opposite direction frees the C-shaped arms 36 for removal from the transom 17. The type and configuration of the transom bracket 32 can vary from what is shown and described. In other examples, the transom bracket 32 is fixed to the transom 17 by fasteners.

The swivel bracket 34 is pivotable with respect to the C-shaped arms 36 about a pivot shaft that laterally extends through the forward upper ends of the C-shaped arms 36, thereby defining a trim axis 38. Pivoting of the swivel bracket 34 about the pivot shaft trims the outboard motor 10 relative to the marine vessel, for example out of and/or back into the body of water in which the marine vessel is operated. A selector bracket 44 having holes is provided on at least one of the C-shaped arms 36. Holes respectively become aligned with a corresponding mounting hole on the swivel bracket 34 at different selectable trim positions for the outboard motor 10. A selector pin (not shown) can be manually inserted into the aligned holes to thereby lock the outboard motor 10 in place with respect to the trim axis, all as is conventional.

The outboard motor 10 is supported on the swivel bracket 34 by a steering arm 64 and a steering tube 66 (see FIG. 2), which is fixed to the steering arm 64 and seated in a swivel cylinder 48 of the swivel bracket 34. The steering arm 64 has a first end which is fixed to a supporting frame or other component of the outboard motor 10 and an opposite, second end configured to be coupled to a manually operable tiller 100. The outboard motor 10 can be steered left or right relative to the marine vessel by rotating about a steering axis 62 defined by the steering tube 66 and swivel cylinder 48 via the tiller 100.

Figure 3:
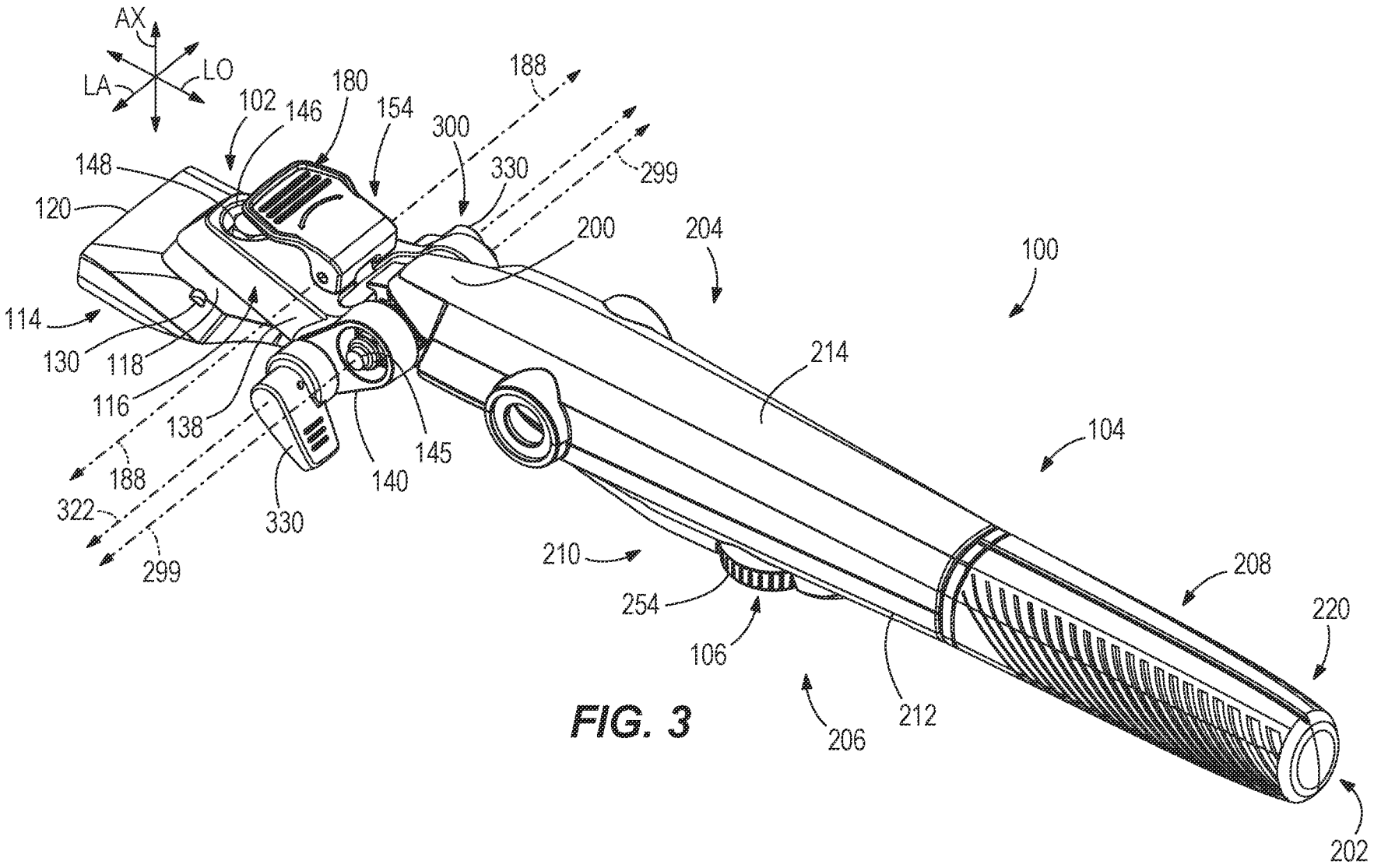
FIG. 3 is a perspective view looking down at a tiller according to the present disclosure.

FIG. 3 illustrates a non-limiting example of a tiller 100 for controlling marine drive, such as an outboard motor. In general, the tiller 100 has a base bracket assembly 102 and a tiller arm 104 which is coupled to and extends outwardly from the base bracket assembly 102. The tiller 100 has several novel attributes which will be further explained herein below. Briefly, the base bracket assembly 102 is specially configured to facilitate yaw adjustment of the tiller arm 104, in particular into and between a variety of yaw positions relative to the marine drive. In addition, the tiller arm 104 has a novel grip restraining device 106 which is located on the bottom of the middle portion of the tiller arm 104 and is manually accessible from both sides of the tiller arm 104 for ambidextrous use. The grip restraining device 106 is specially configured to selectively restrain rotation of a hand grip 220 on the outer end of the tiller arm 104. In addition, the tiller arm 104 has a tilt mechanism 300 which facilitates tilting of the tiller arm 104 relative to the base bracket assembly 102 into and between a variety of tilt positions, including a straight upwardly extending tilt position and a straight downwardly extending tilt position (see FIG. 17) for manual carrying of the marine drive via the tiller arm 104.

Referring to FIGS. 4-8, the base bracket assembly 102 includes a yaw bracket 114 and a steering bracket 116. The yaw bracket 114 is a rigid member having a body 118 and a base 120 which extends from the body 118 and is configured for fixed mounting to a steering arm 64 of the marine drive, by for example fasteners extending through holes 122 (see FIG. 8) in the end of the base 120. The body 118 of the yaw bracket 114 provides a pedestal 124. A through-bore 126 (FIG. 6) extends through the center portion of the pedestal 124. Three engagement recesses 128 extend into the pedestal 124. Each engagement recess 128 has a drain hole 129 (FIG. 5) which drains fluid that may accumulate in the engagement recess 128 during normal use. The three engagement recesses 128 are spaced apart fifteen degrees relative to the through-bore 126. Opposing partial recesses 130 (FIG. 6) are formed in the opposing sidewalls of the body 118 and are located one-hundred-and-eighty degrees apart from each other relative to the center of the through-bore 126. The center-most of the engagement recesses 128 is located ninety degrees apart from each of the partial recesses 130, respectively, relative to the center of the through-bore 126. The engagement recesses 128 and partial recesses 130 together span one-hundred-and-eighty degrees relative to the center of the through-bore 126. A washer 132 is seated in an annular cavity 136 extending about the through-bore 126.

The steering bracket 116 is a rigid member having a body 138 and a pair of upwardly angled arms 140 having opposed lower through-bores 142 through the lower ends of the arms 140 and opposed through-bores 144 through the upper ends of arms 140. A fastener 145 extends through the opposed through-bores 144 and through a corresponding through-bore 147 (FIG. 4) in the tiller arm 104 so as to couple the tiller arm 104 to the steering bracket 116 in a way that the tiller arm 104 is tiltable up and down relative to the steering bracket 116, as will be further described herein below.

A through-bore 146 (FIG. 6) extends through the body 138. A fastener 148 extends through the through-bore 146, through the washer 132 and through the through-bore 126 in the body 118 and into threaded engagement with a threaded bolt cap 151. The fastener 148 has a body 150 with a smooth outer surface, which is disposed in the through-bore 146, the washer 132 and the through-bore 126 when the fastener 148 is in its position of use. As such, the steering bracket 116 is rotatable in either direction relative to the yaw bracket 114 about the fastener 148. As explained above, the yaw bracket 114 is fixed to the steering arm of the marine drive and the steering bracket 116 is attached to the tiller arm 104. Thus, the tiller arm 104 and steering bracket 116 are pivotable together about the yaw axis 152 (FIG. 5) defined by the fastener 148 into and between a variety of yaw positions relative to the yaw bracket 114 and marine drive, as will be further described herein below.

Figure 5:
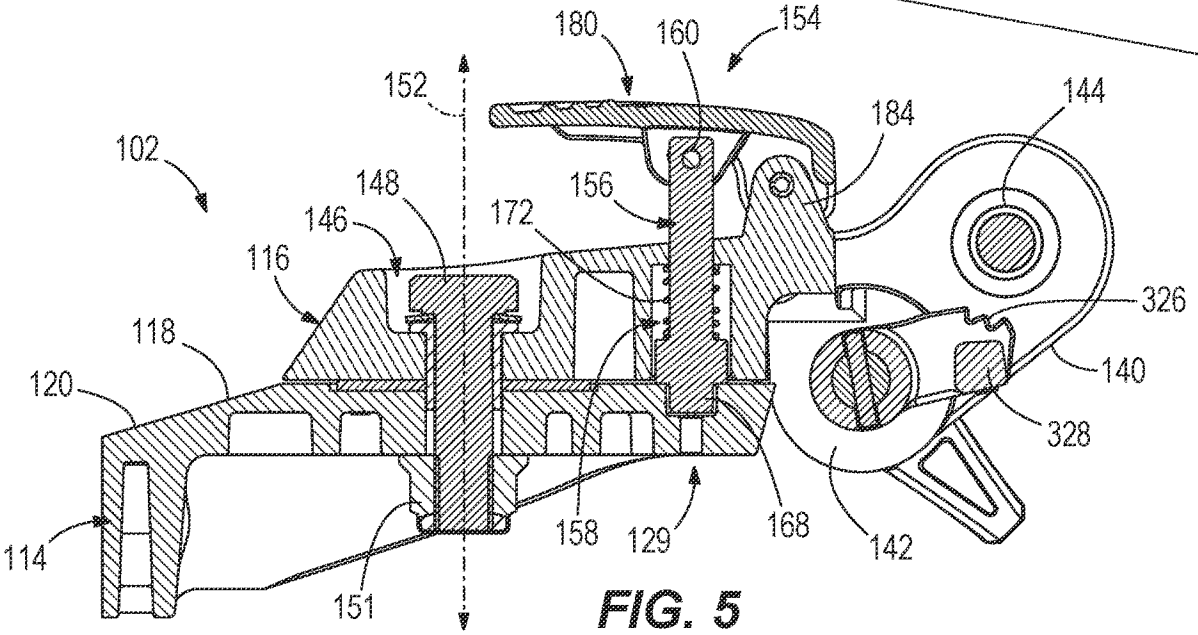
FIG. 5 is a section view of the base bracket assembly.
Figure 6:
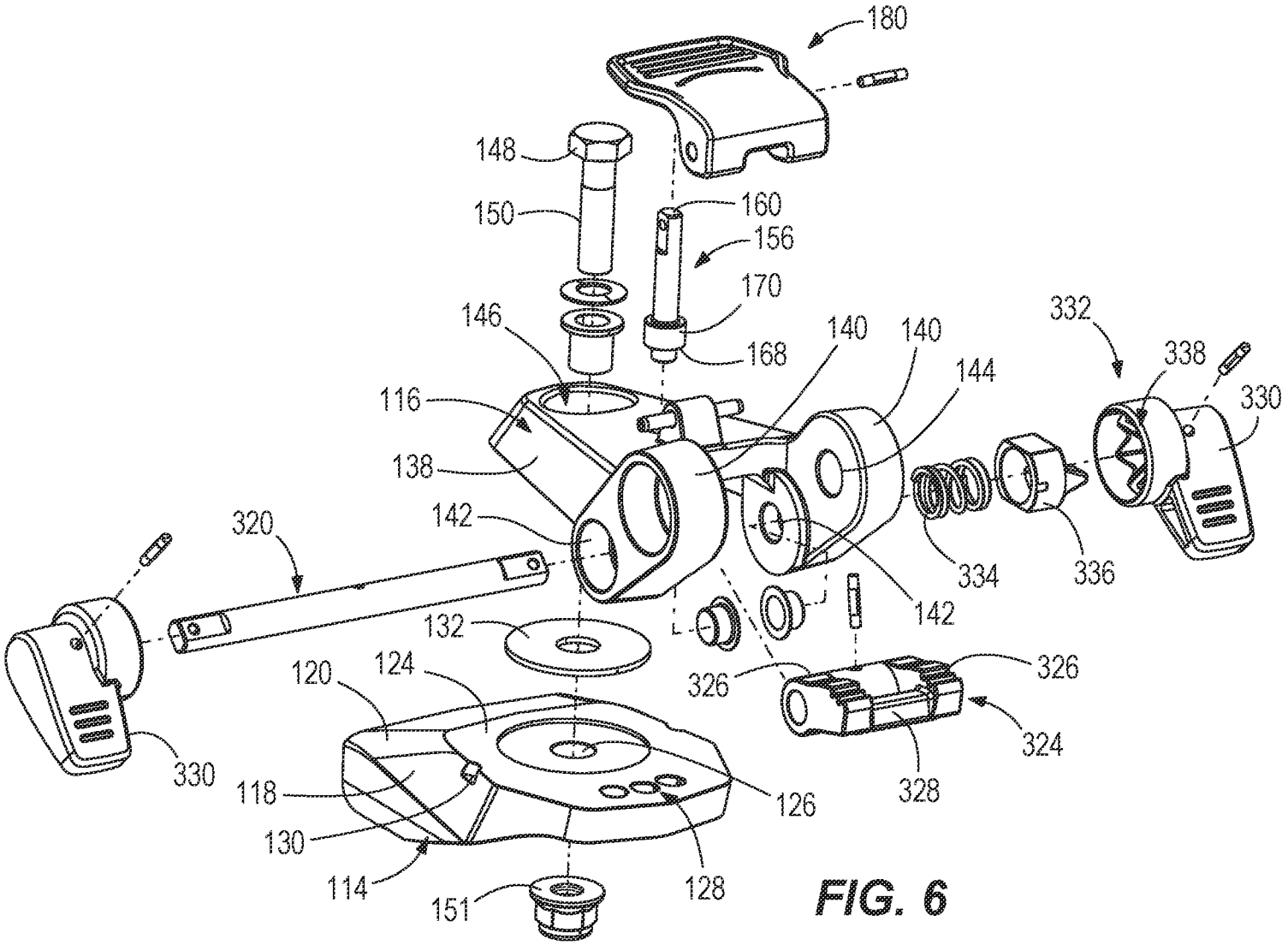
FIG. 6 is an exploded view of the base bracket assembly.
Figure 7:
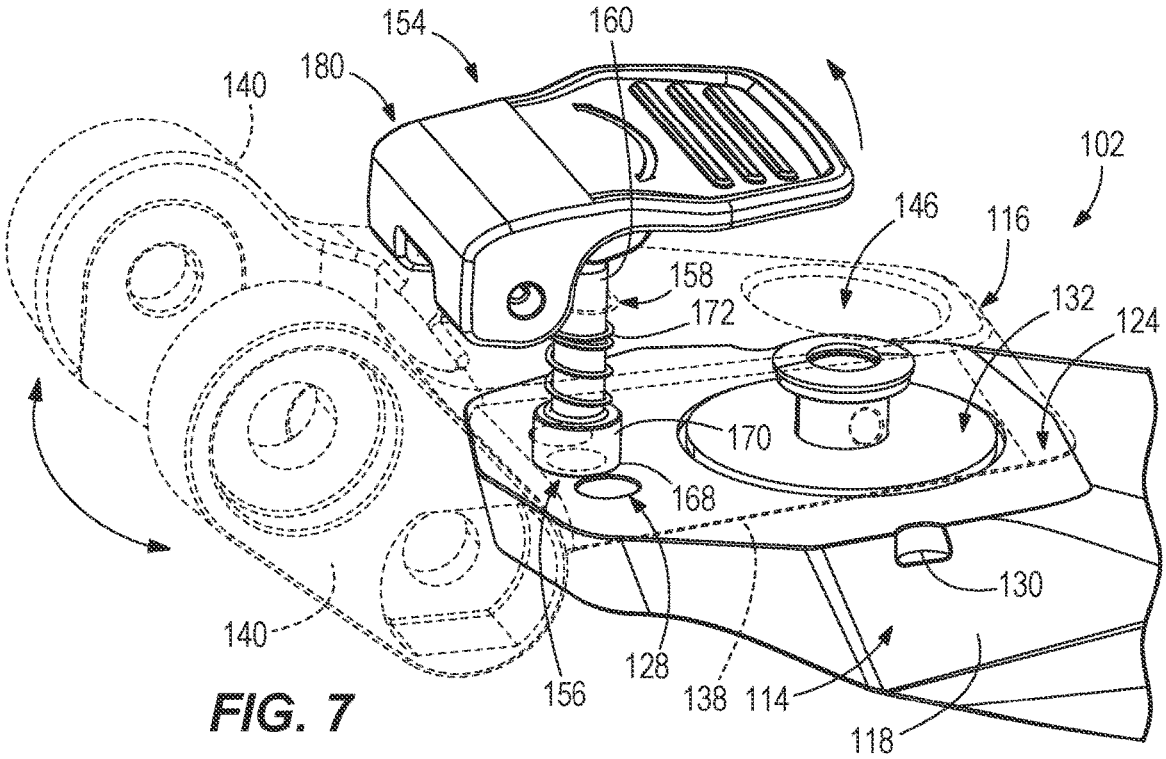
FIGS. 7 and 8 are perspective views, partially in phantom, illustrating a yaw lock.
Figure 8:
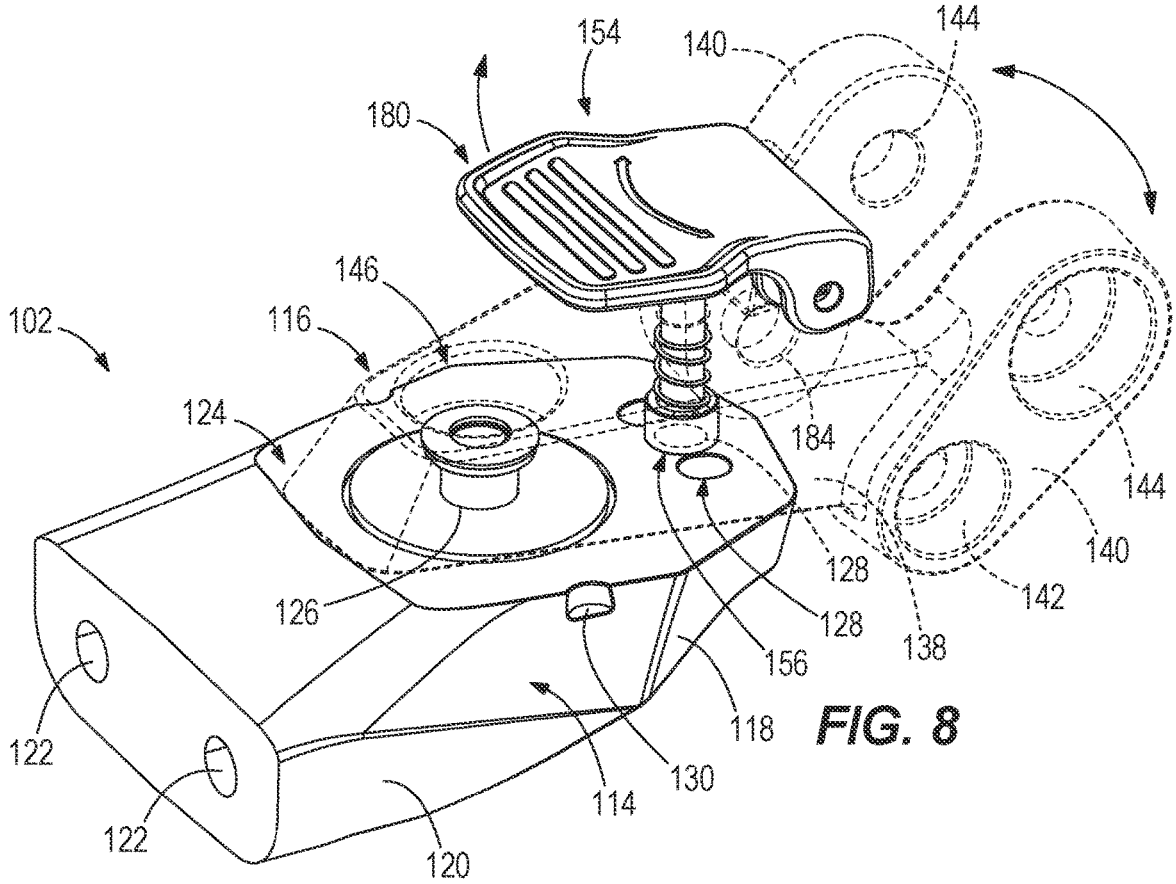
Figure 9:
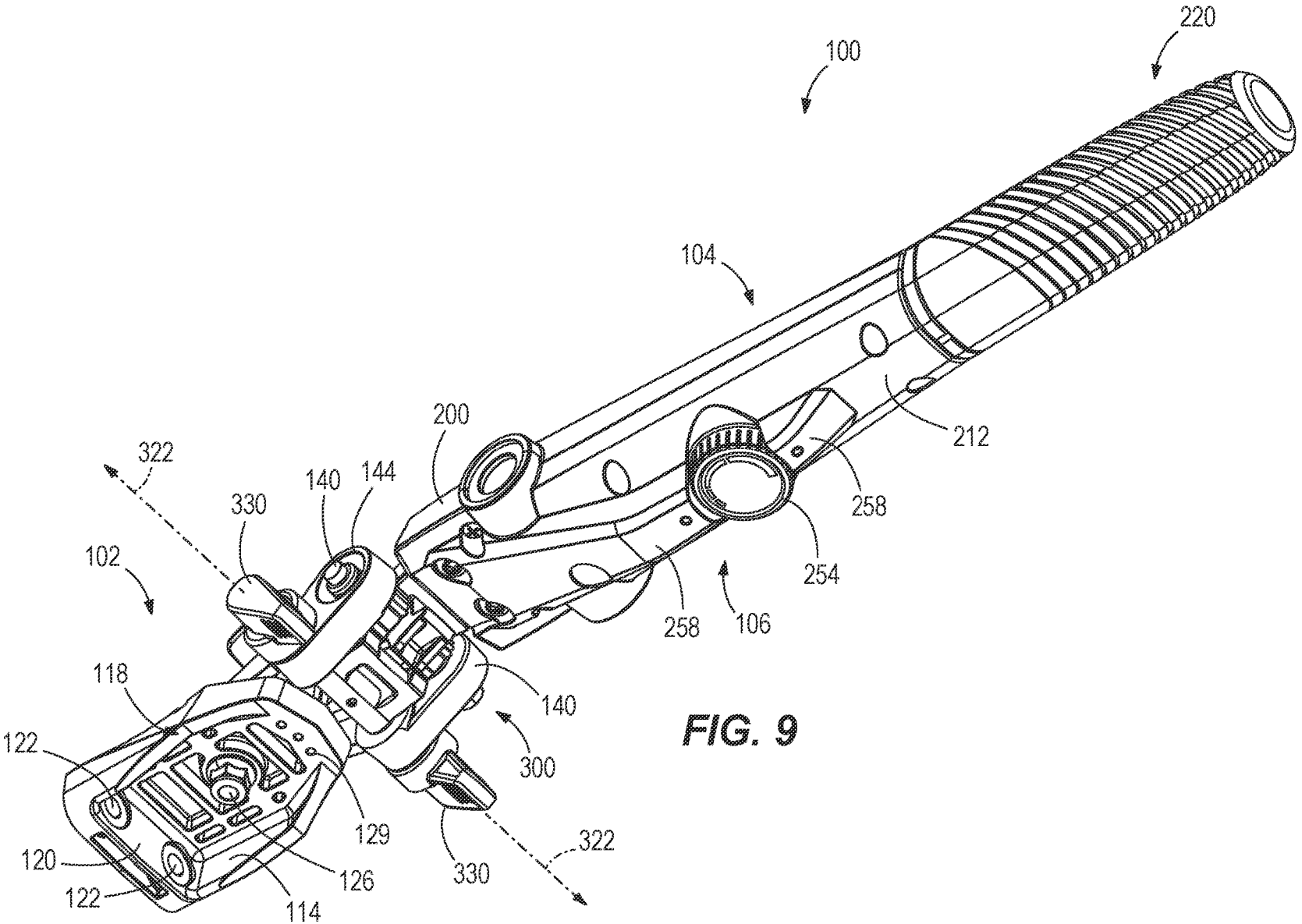
FIG. 9 is a perspective view looking up at the tiller arm.
Figure 10:
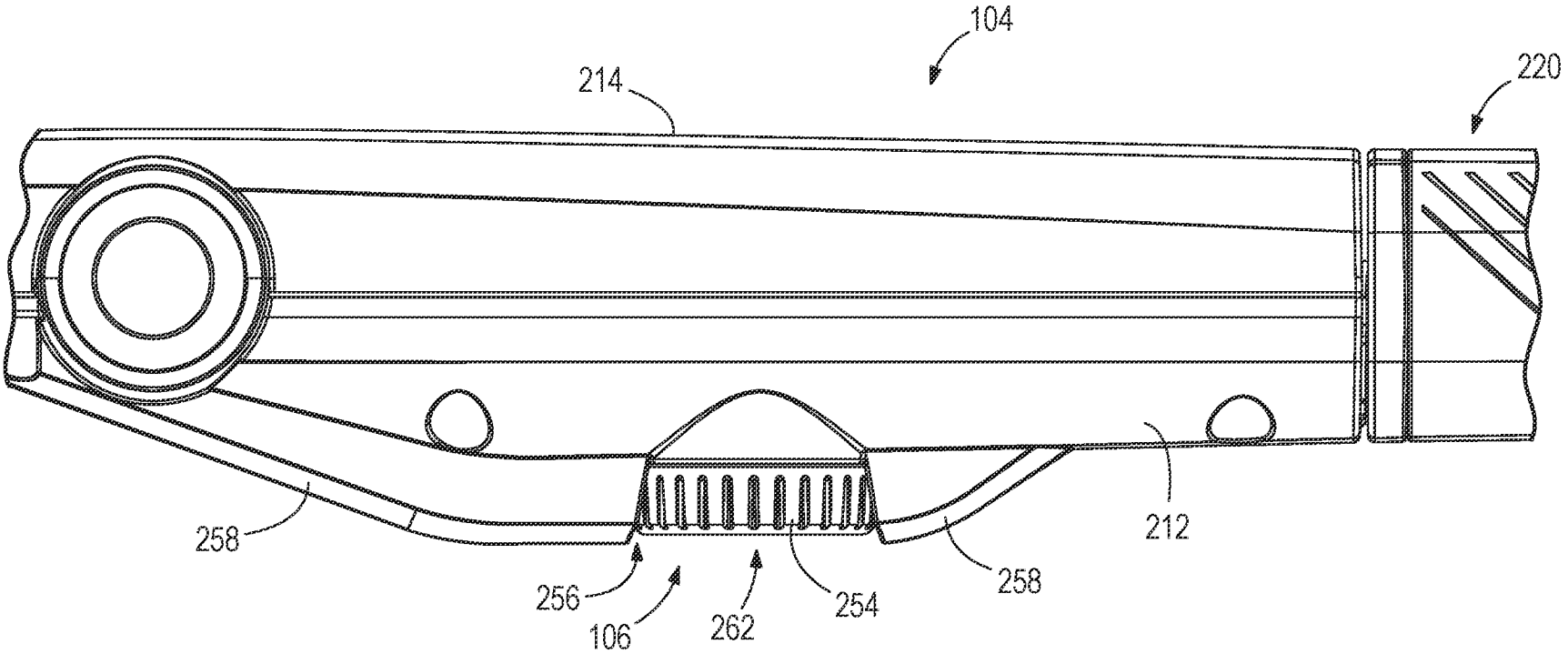
FIG. 10 is a side view of the tiller arm along the grip restraining device.

A yaw lock 154 (FIG. 5) is specially configured to lock the tiller arm 104 and steering bracket 116 in a variety of yaw positions relative to the yaw bracket 114 and marine drive, as shown by arrows in FIGS. 7 and 8. The yaw lock 154 includes a plunger 156 which resides in a through-bore 158 in the steering bracket 116 which defines an internal cavity and relatively smaller top and bottom openings in the body 138 of the steering bracket 116. Referring to FIGS. 5 and 6, the plunger 156 is an elongated member with a top end 160 which normally protrudes out of the top opening, a bottom end 168 which in a locked position protrudes out of the bottom opening, and a relatively enlarged annular body 170 which is trapped in the cavity because it is too big to pass through top and bottom openings. A coiled spring 172 is disposed between the top of the annular body 170 and the inside of the cavity adjacent to the top and normally biases the bottom end 168 of the plunger 156 outwardly relative to the bottom opening into the position shown in FIG. 5.

The yaw lock 154 also includes a release lever 180 located on top of the steering bracket 116 such that it is easily manually accessible from above and from the sides of the tiller 100. The release lever 180 has a first end which is pivotably coupled to mounting boss 184 protruding up from the top of the steering bracket 116, a second end which can be manually lifted by the operator's finger(s) to pivot the release lever 180 upwardly about the pivot axis defined through the mounting boss 184. The top end 160 of the plunger 156 protrudes out of the top opening and is pivotally coupled to the bottom of the middle portion of the release lever 180, between the first end and second end.

FIGS. 7 and 8 show the yaw lock 154 in a locked position wherein the bottom end 168 of the plunger 156 is biased by the spring 172 into the center-most engagement recess 128, which retains the steering bracket 116 in a straight-ahead position relative to the yaw bracket 114 and associated marine drive for straight-ahead steering. As shown by arrows in FIGS. 7 and 8, to change the yaw position of the tiller 100 relative to the marine drive, the user manually pivots the first end of the release lever 180 upwardly relative to the mounting boss 184, which pulls upwardly on the plunger 156 and causes the annular body 170 to compress the coiled spring 172. As this occurs, the second end of the plunger 156 is removed from the yaw bracket 114, which frees the steering bracket 116 and tiller arm 104 for pivoting motion about the yaw axis 152 (FIG. 5) relative to the yaw bracket 114 and marine drive. As discussed above, in the illustrated embodiment, the steering bracket 116 is pivotable through at least one-hundred-and-eighty degrees relative to the yaw bracket 114 and lockable in each of the yaw positions designated by the engagement recesses 128, 130. Particularly, the user can release the release lever 180, which permits the spring 172 to bias the second end of the plunger 156 outwardly towards and into engagement with the pedestal 124. Once the plunger 156 becomes aligned with a next of the engagement recesses 128, 130, the spring 172 will bias the bottom end 168 of the plunger 156 into the engagement recess 128, 130.

As such, it will be understood that unlocking the yaw lock 154 advantageously facilitates movement of the tiller arm 104 into a new yaw position relative to the marine drive. In the non-limiting illustrated embodiment, the tiller arm 104 and steering bracket 116 are pivotable through one-hundred-and-eighty degrees relative to the yaw bracket 114. It will also be understood that the yaw lock 154 is advantageously configured such that upon movement of the tiller arm 104 and steering bracket 116 into the new yaw position, the yaw lock 154 automatically locks the tiller arm 104 and steering bracket 116 in the new yaw position via engagement of the spring-loaded plunger 156 with another engagement recess 128, 130 of the plurality of recesses.

Referring to FIG. 3, the tiller arm 104 extends from an inner end 200 to an outer end 202 in a longitudinal direction LO, from top 204 to bottom 206 in an axial direction AX which is perpendicular to the longitudinal direction LO, and from a first side 208 to a second side 210 which is opposite the first side 208 in a lateral direction LA which is perpendicular to the longitudinal direction LO and perpendicular to the axial direction AX.

Figure 11:
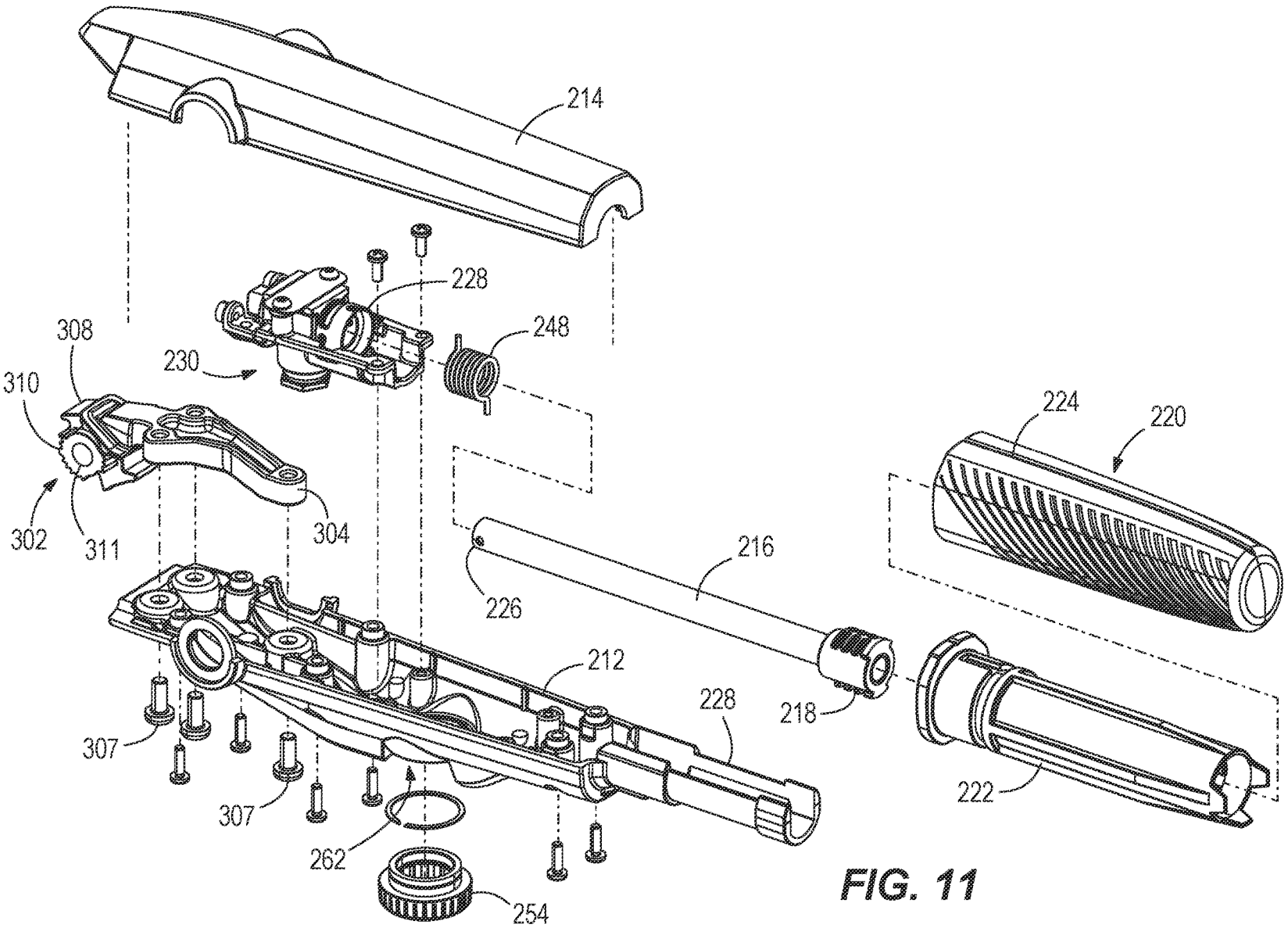
FIG. 11 is an exploded view illustrating the tiller arm.
Figure 12:
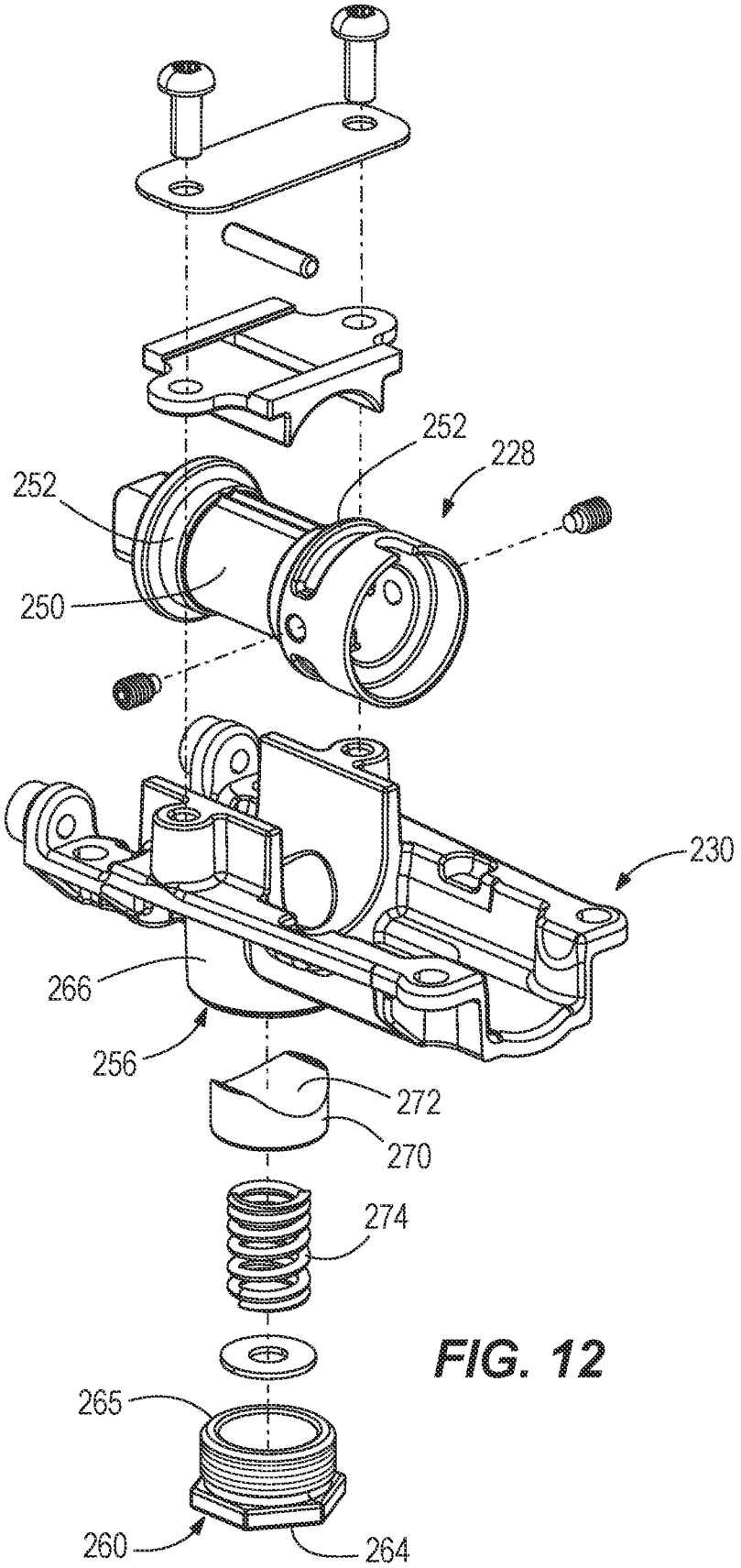
FIG. 12 is an exploded view illustrating the grip restraining device.

Referring to FIG. 3, tiller arm 104 has a chassis 212 which is elongated in the longitudinal direction LO and underlies and supports various components associated with the tiller arm 104. A cover 214 is mounted on top of chassis 212 and encloses the various components in an interior of the tiller arm 104. Referring to FIG. 11, a shaft 216 protrudes from the interior via a passage defined between the front of the chassis 212 and cover 214. The shaft 216 is rotatable about its own axis and has a front end 218 which is coupled to a hand grip 220. The hand grip 220 includes a grip member 222 and a grooved grip cover 224. The shaft 216 is coupled to the hand grip 220 such that manually rotating the hand grip 220 relative to the chassis 212 and cover 214 causes rotation of the shaft 216 relative to the chassis 212 and cover 214. The shaft 216 has a rear end 226 which includes a shaft extension 228 located within a supporting tray 230. A magnetic sensor is mounted to the supporting tray 230 and is configured to sense rotation of the shaft 216 (via the shaft extension 228) and communicate such sensed rotation to a controller for the associated marine drive. Sensing arrangements for sensing rotation of a shaft in a tiller arm are conventional and well known in this art and thus not further herein described. As such, it will be understood that rotation of the hand grip 220 causes rotation of the shaft 216, including shaft extension 228 within the supporting tray 230 and such rotation in turn causes change in the speed of the marine drive.

Figure 13:
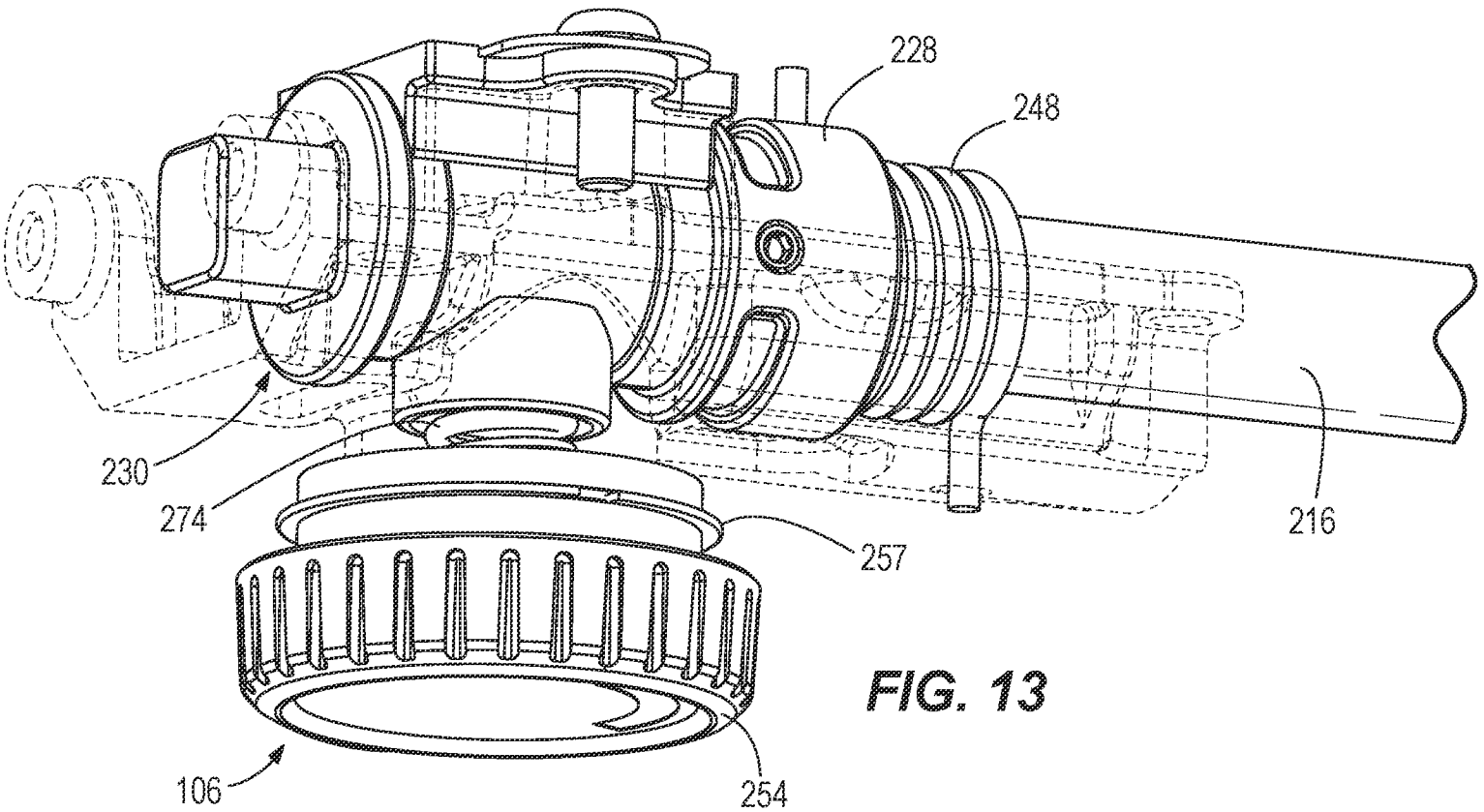
FIG. 13 is a perspective view, partially in phantom, illustrating the grip restraining device.
Figure 14:
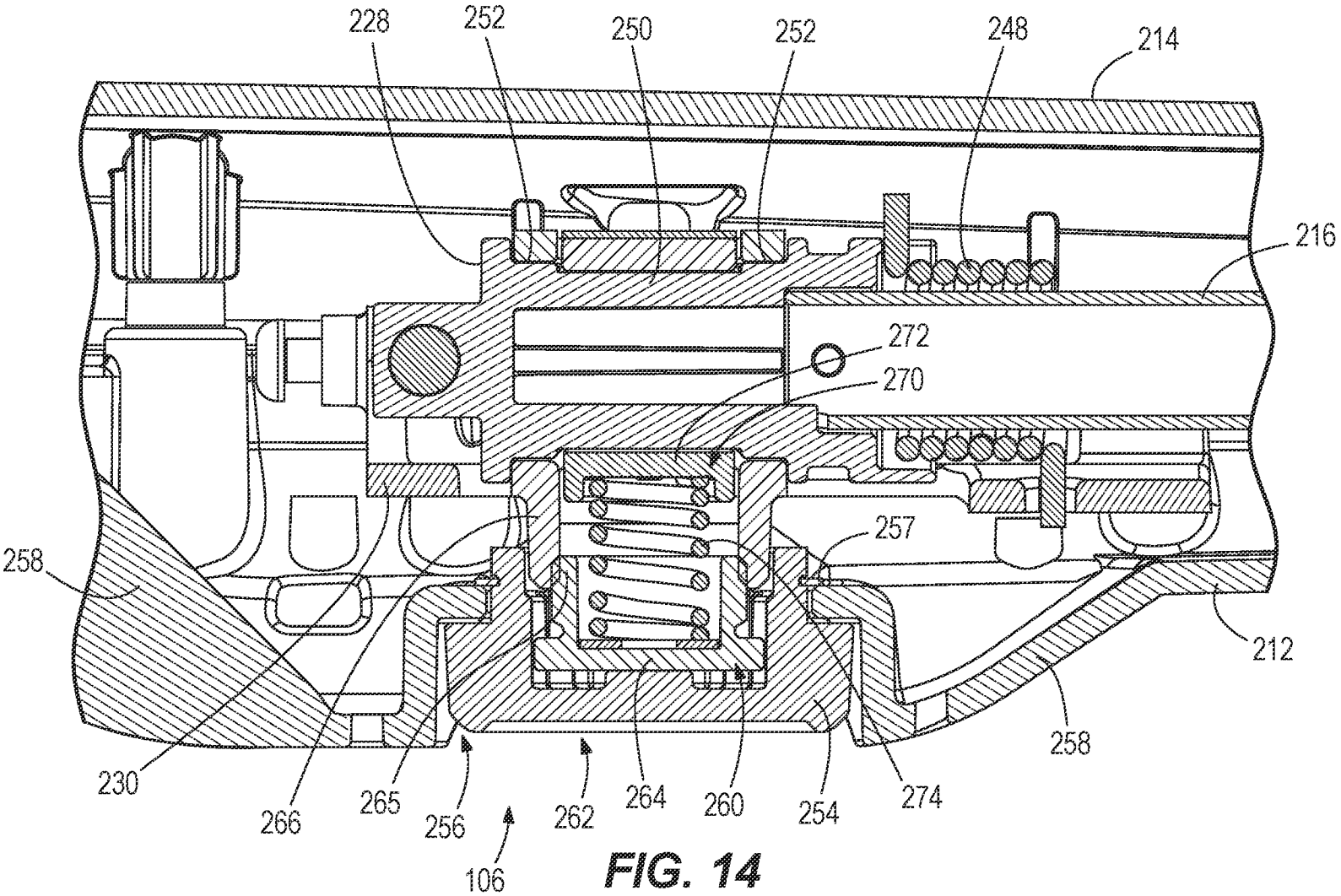
FIG. 14 is a section side view of the grip restraining device.
Figure 15:
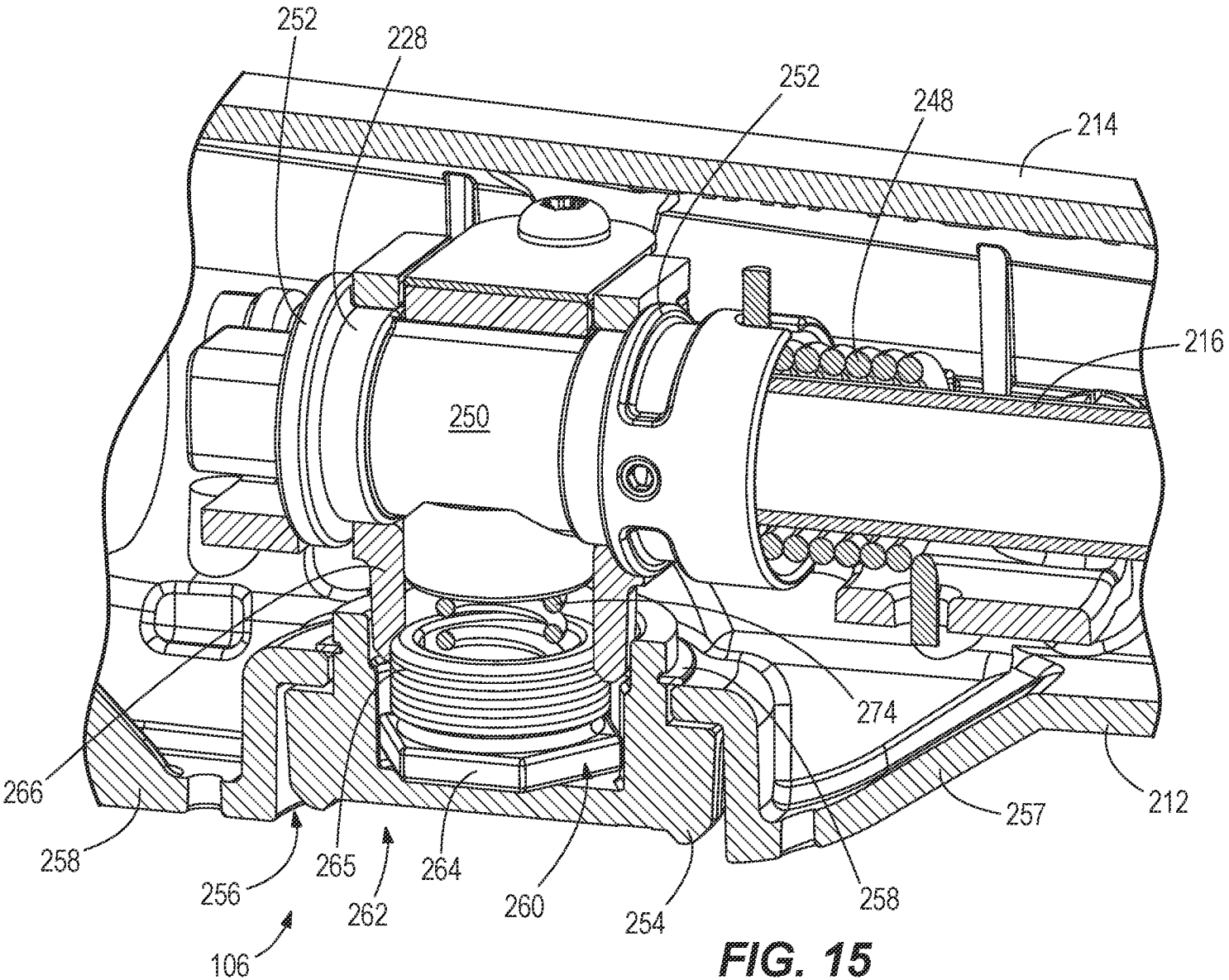
FIG. 15 is a perspective view of the grip restraining device.
Figure 16:
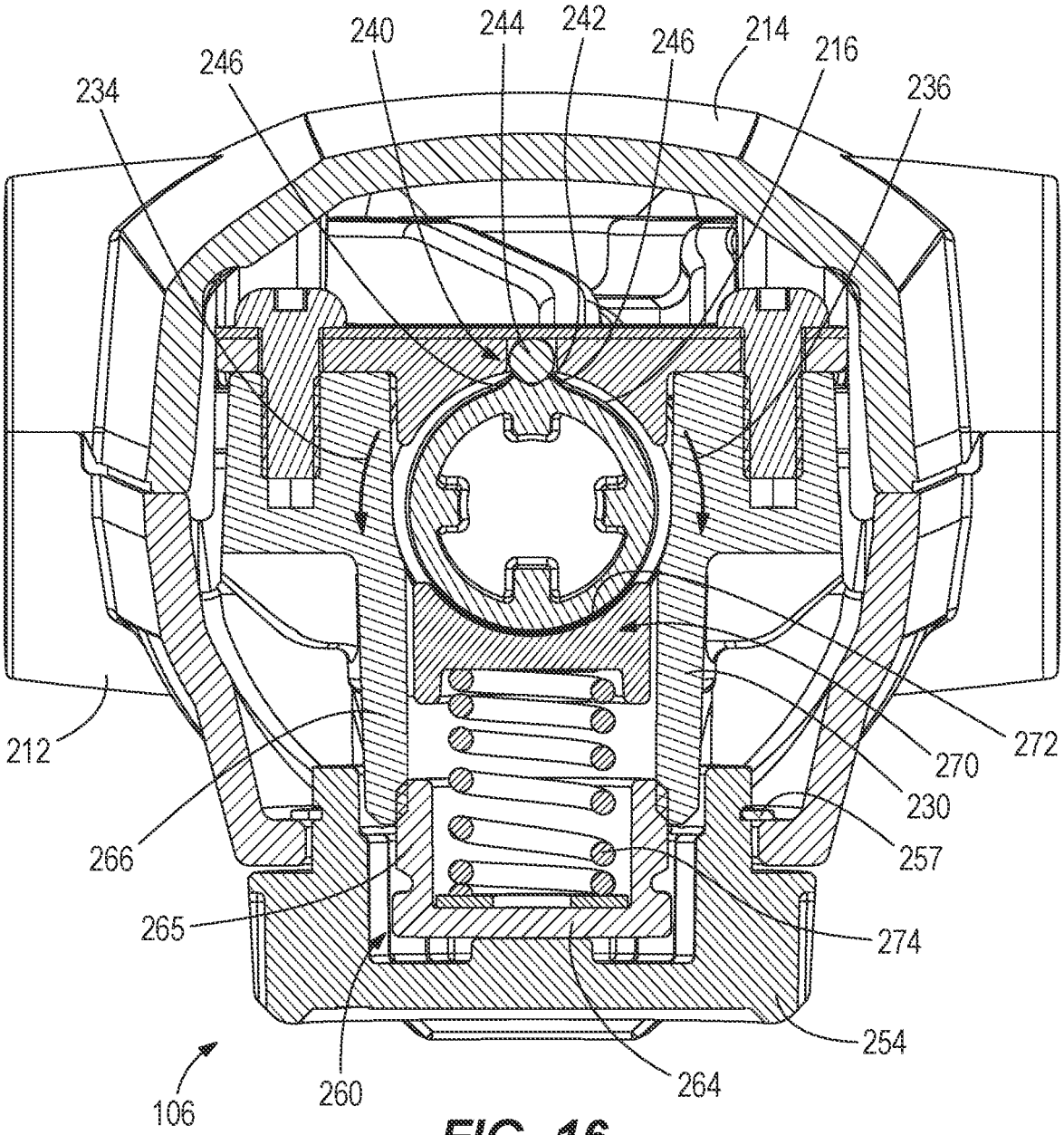
FIG. 16 is a sectional end view illustrating the grip restraining device.

Referring to FIG. 16, the hand grip 220 and shaft 216, including shaft extension 228, are rotatable in opposite directions away from the center position shown and thus is configured for ambidextrous use. That is, the hand grip 220 can be rotated in the direction of arrow 234 to increase the speed of the marine drive and alternately the hand grip 220 can be rotated in the direction of arrow 236 to increase the speed of the marine drive, a detent mechanism 240 provides tactile feedback to the user grasping the hand grip 220 when the hand grip 220 is rotated into the center position shown, which corresponds to neutral position for the marine drive. The detent mechanism 240 includes a raised groove 242 on the top of the outer diameter of the shaft extension 228 and a roller pin 244 which is coupled to the supporting tray 230 and which becomes aligned with and pops into the raised groove 242 when the hand grip 220 and shaft 216 are rotated into the center position. Seating of the roller pin 244 provides tactile feedback in the form of a click which can be felt by the user grasping the hand grip 220. Smoothly contoured surfaces 246 provide ramps on opposite sides of the raised groove 242 leading up to the groove and thus provide a gradually increasing resistance to the user rotating the hand grip 220 towards the center position until the roller pin 244 becomes aligned with and seats in the raised groove 242. Referring to FIGS. 13-15, in the illustrated example a coiled torsion spring 248 is disposed on the shaft 216 and has a first end attached to the shaft 216 and an opposite, second end attached to the supporting tray 230. In other examples, the coiled torsion spring 248 can include one of two or more springs having opposite winding. The torsion spring 248 rotationally biases the shaft 216 towards the center position shown in FIG. 16, however the bias force provided by the torsion spring 248 is not great enough to overcome the engagement force between the roller pin 244 and the ramped surfaces 246. Instead, it is necessary to apply manual rotational force on the shaft 216 via the hand grip 220 to bring the raised groove 242 into alignment with the roller pin 244. As such, it will be understood that manually grasping and rotating the hand grip 220 away from the center position in either direction 234, 236 increases the speed of the marine drive. Manually releasing the hand grip 220 permits the bias of the torsion spring 248 to rotate the shaft 216 and hand grip 220 back towards the center position until the respective ramped surface 246 engages the roller pin 244. To fully move the hand grip 220 back to the center position, the user must grasp and rotate the hand grip 220 with a force needed to push the ramped surface 246 past the roller pin 244 so that the roller pin 244 will pop into place in the raised groove 242.

Referring to FIGS. 13-16, the grip restraining device 106 is specially configured to restrain rotation of the shaft 216 and thus rotation of the hand grip 220. This is useful when the user wants to maintain a certain speed of the marine drive without having to continuously hold the hand grip 220. This is also useful when the user wants to vary the amount of resistance which the hand grip 220 provides to rotational force. Some users prefer a hand grip which is more difficult to rotate. Others prefer a hand grip which is easier to rotate. The grip restraining device 106 advantageously allow the user to selectively vary and set the resistance.

The grip restraining device 106 restrains rotation of the hand grip 220 by frictionally engaging the outer diameter of the shaft extension 228 of the shaft 216. The shaft extension 228 is a generally cylindrical member having a groove 250 extending around its outer diameter. The groove 250 has flanges 252 which are retained in axial position by supporting surfaces of the supporting tray 230. The grip restraining device 106 generally includes a dial 254 which is mounted to a hole 256 in the bottom of middle portion of the chassis 212 of the tiller arm 104. A snap ring 257 mounts the upper portion of the dial 254 to the chassis 212 such that the dial 254 is freely rotatable relative to the chassis 212. Opposed ramped bottom walls 258 extend from the bottom of the chassis 212 and define a protective recess in which the dial 254 resides. Side cutouts 262 are defined in each of the bottom walls 258 and expose the outer diameter of the dial 254 on both first and second sides 208, 210 of the tiller arm 104.

The grip restraining device 106 further includes a shuttle 260 which is disposed in the dial 254, The shuttle 260 has an end 264 which is coupled to the interior of the dial 254 by flats such that rotation of the dial 254 causes rotation of the shuttle 260. The shuttle 260 has an opposite narrower end 265 which extends into and is engaged with the inner diameter of a boss 266 protruding downwardly from the supporting tray 230 by a threaded connection. As such, the shuttle 260 is coupled to the dial 254 and to the boss 266 in the supporting tray 230 such that rotation of the dial 254 in a first direction causes rotation of the shuttle 260 in the first direction, which causes the shuttle 260 to travel axially upwardly further into the boss 266 and towards the shaft extension 228. Rotation of the dial 254 in an opposite, second direction causes rotation of the shuttle 260 in the second direction, which causes the shuttle 260 to travel axially downwardly, outwardly relative to the boss 266, further away from the shaft extension 228.

The grip restraining device 106 further includes a friction plunger 270 which resides within the boss 266. The plunger 270 has an outer friction surface 272 which is curved to match and abut the curved outer diameter of the groove 250 of the shaft extension 228. A coiled spring 274 has a first end abutting the interior of the shuttle 260 and a second end abutting the inner surface of the friction plunger 270. The spring 274 tends to bias the friction plunger 270 away from the shuttle 260 and into frictional engagement with the groove 250 of the shaft extension 228.

As such, it will be understood that rotation of the dial 254 in a first rotational direction causes the shuttle 260 to axially move towards the shaft extension 228, which compresses the spring 274 and increases the force of which the friction plunger 270 frictionally engages with the shaft extension 228. This increases the restraining force or resistance to manual rotation of the hand grip 220. Rotation of the dial 254 in the opposite, second rotational direction causes the shuttle 260 to axially move away from the shaft extension 228, which allows the spring 274 to relax and decreases the force of which the friction plunger 270 engages with the shaft extension 228. This decreases the restraining force or resistance to manual rotation of the hand grip 220. Advantageously, the grip restraining device 106 is manually operable from either side 108, 110 of the tiller arm 104 and thus is configured for ambidextrous use. This is particularly advantageous in the illustrated embodiment wherein the hand grip 220 is rotatable relative to the tiller arm 104 through at least one-hundred-and-eighty degrees, including 90 degrees away from the center position in the first rotational direction (for right-handed use of the tiller 100), and 90 degrees away from the center position in the opposite, second direction (for left-handed use of the tiller 100).

Figure 4:
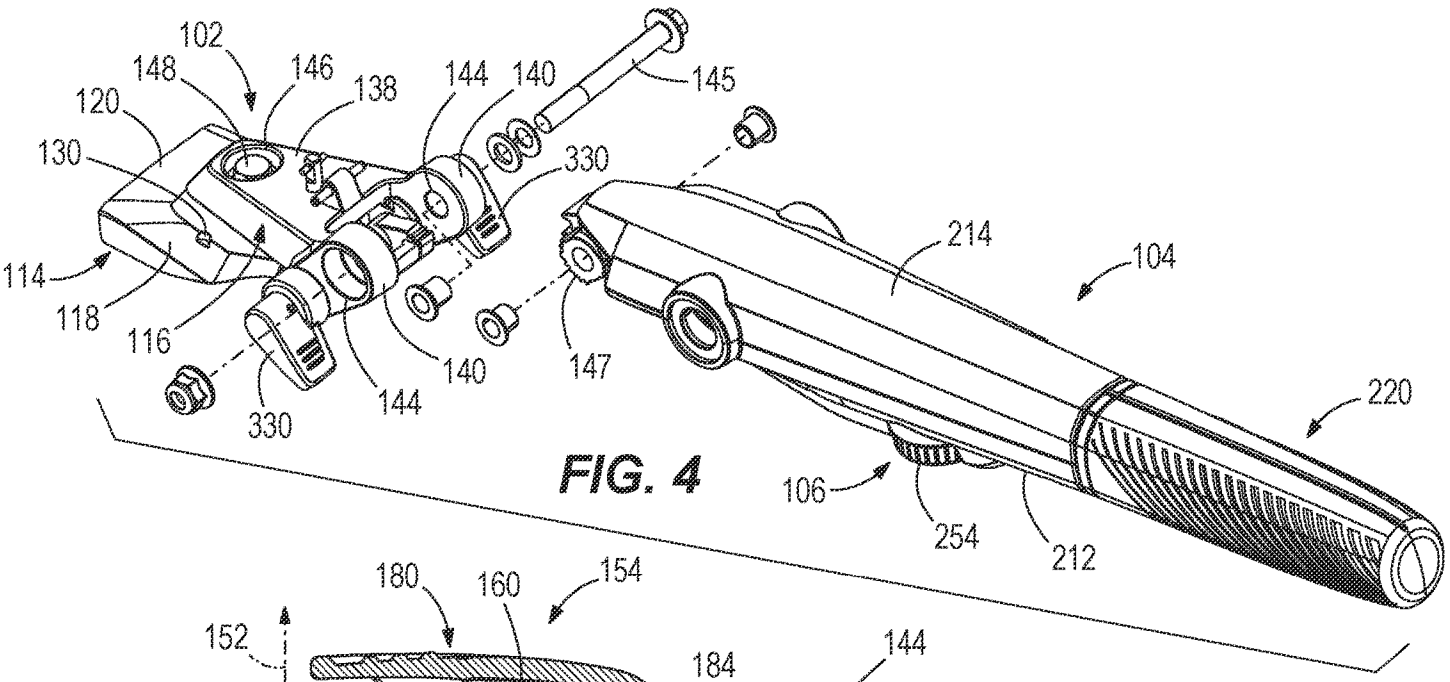
FIG. 4 is an exploded view of the tiller, illustrating a tiller arm including a chassis, a cover and a hand grip, spaced apart from a base bracket assembly comprising a yaw bracket and a steering bracket.

As described herein above with reference to FIGS. 3 and 4, the tiller 100 is pivotable relative to the base bracket assembly 102 via connection between the fastener 145 which extends through a through-bore 147 in the tiller arm 104, through the opposed through-bores 144 in the arms 140. The fastener 145 defines a tilt axis 299 about which the tiller arm 104 is pivotable relative to the base bracket assembly 102.

Figure 17:
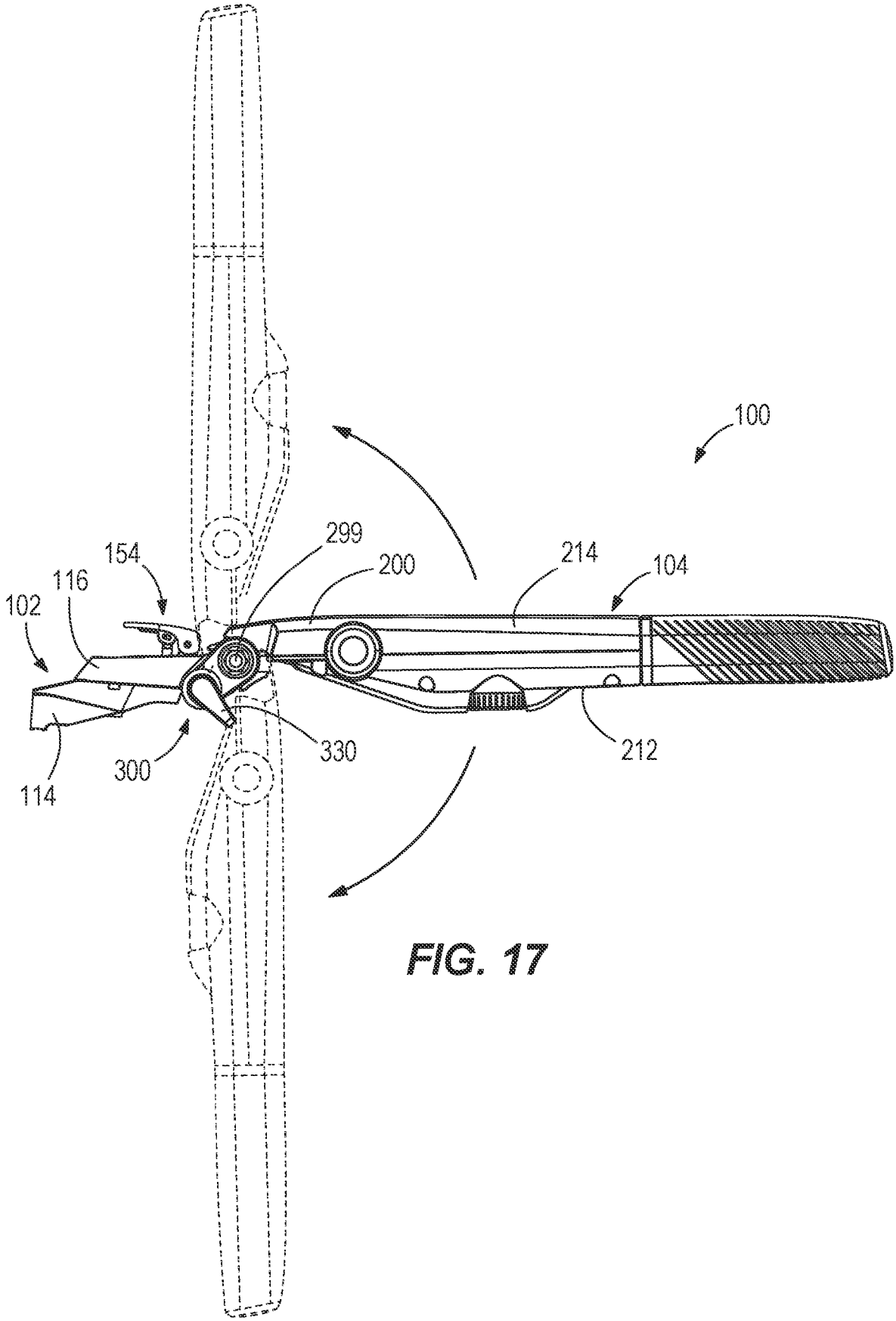
FIG. 17 is a side view illustrating the base bracket assembly and tiller arm, with the tiller arm shown in phantom line in a vertically straight up tilt position and in a vertically straight down tilt position.
Figure 18:
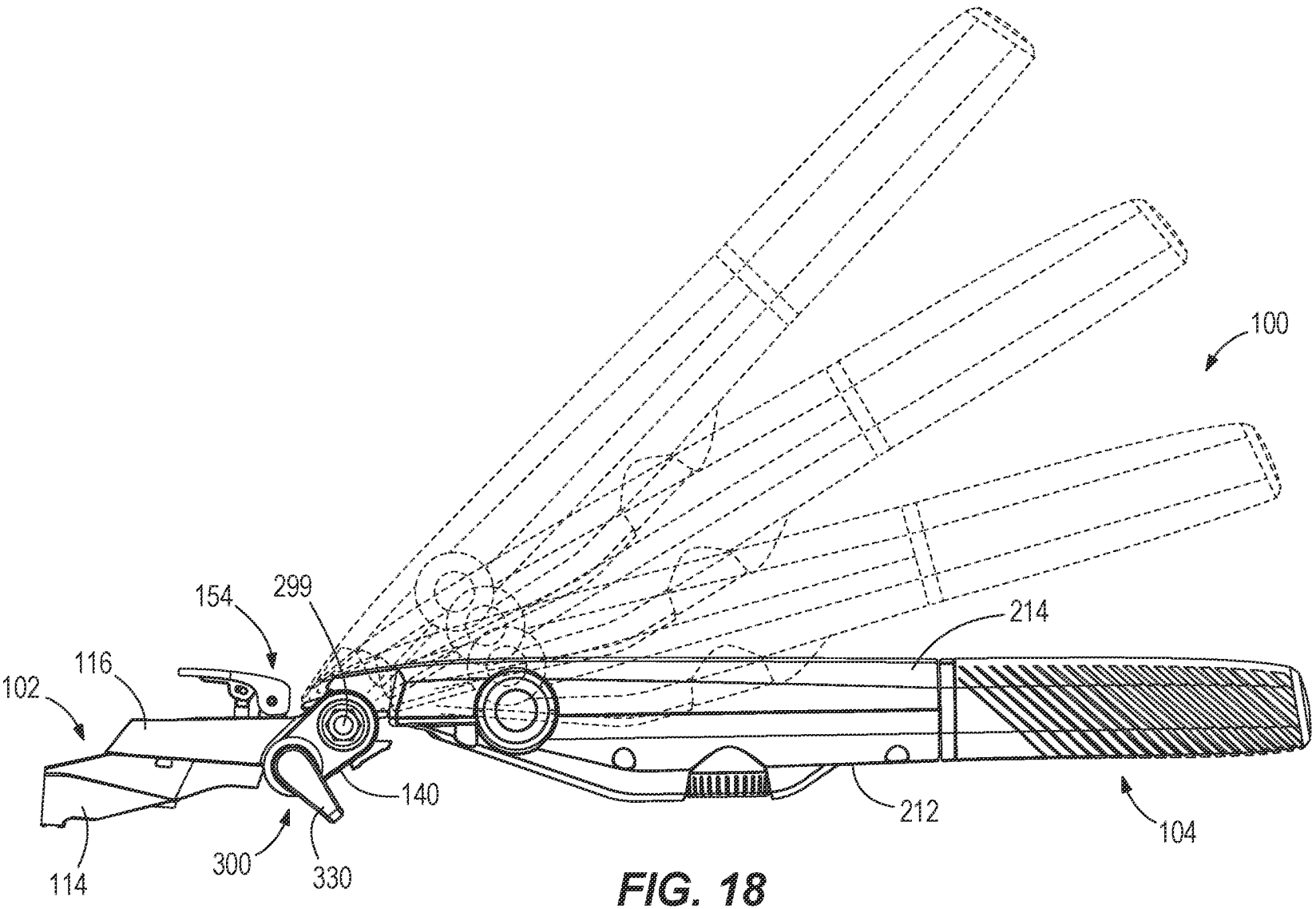
FIG. 18 is a side view illustrating the base bracket assembly and tiller arm, with the tiller arm shown in phantom line in a range of tilt positions.
Figure 19:
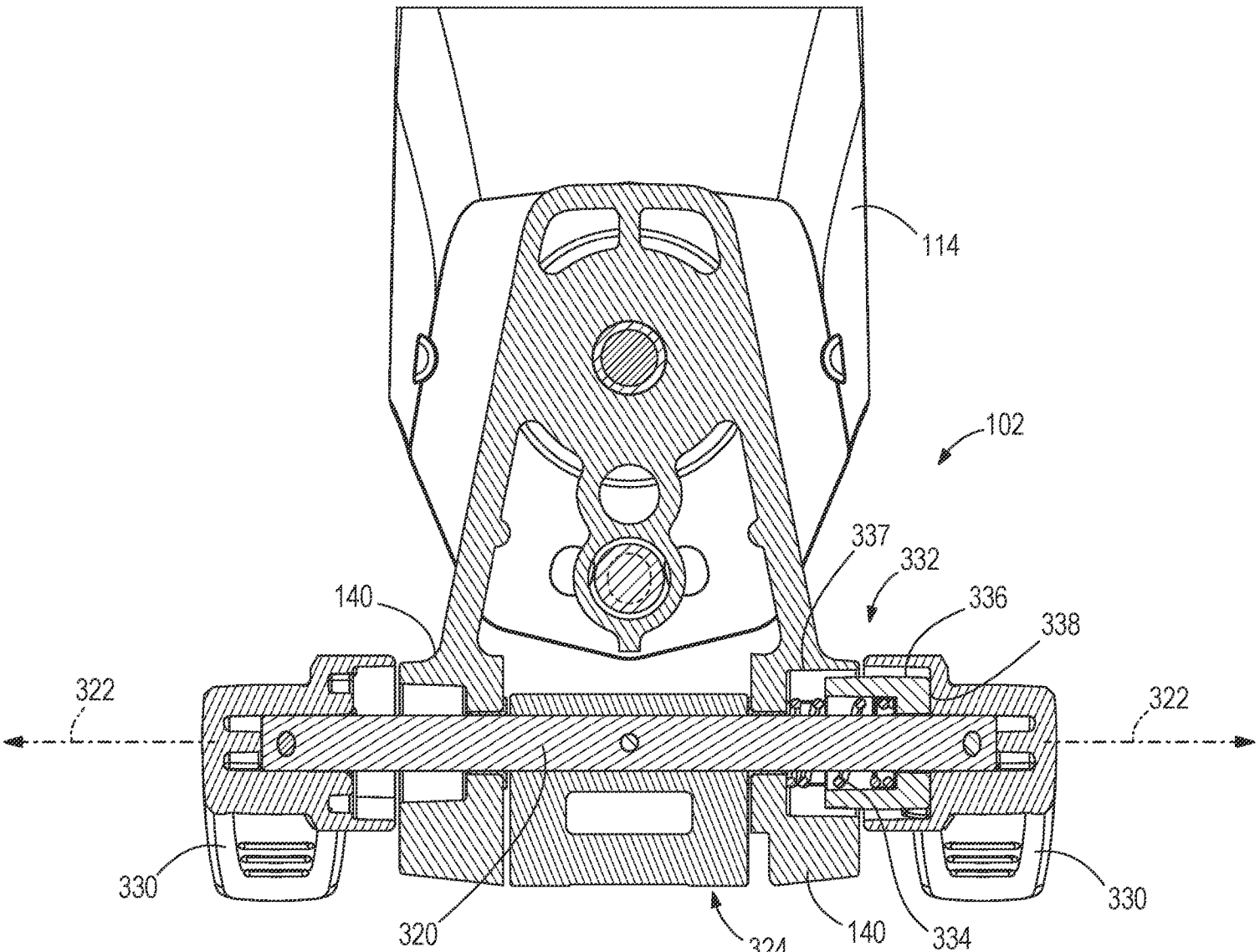
FIG. 19 is a sectional view of the tiller illustrating portions of a tilt mechanism for the tiller, including a tilt shaft, tilt levers, and a cam device.
Figure 20:
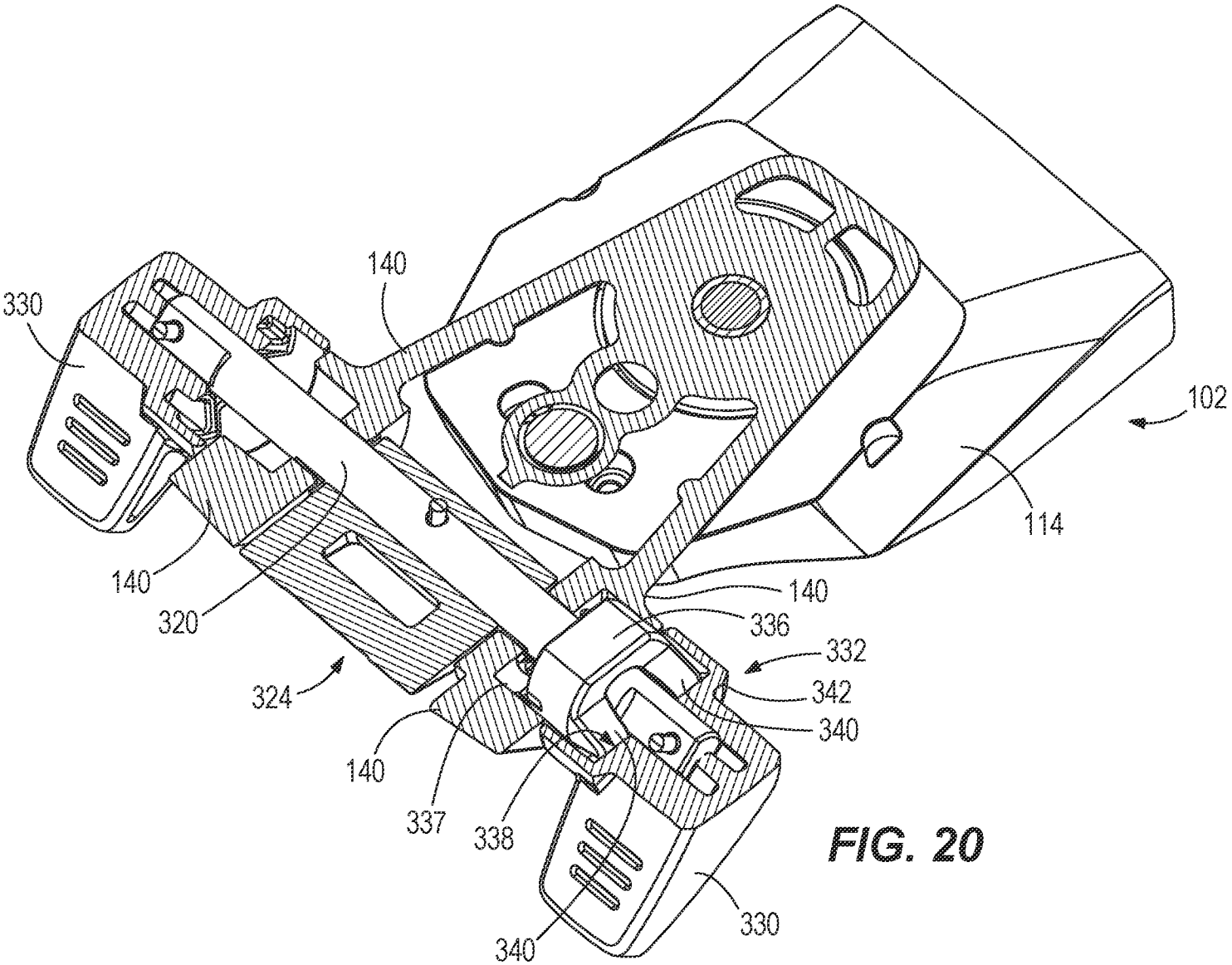
FIG. 20 is a view like FIG. 17, taken from a different perspective.
Figure 21:
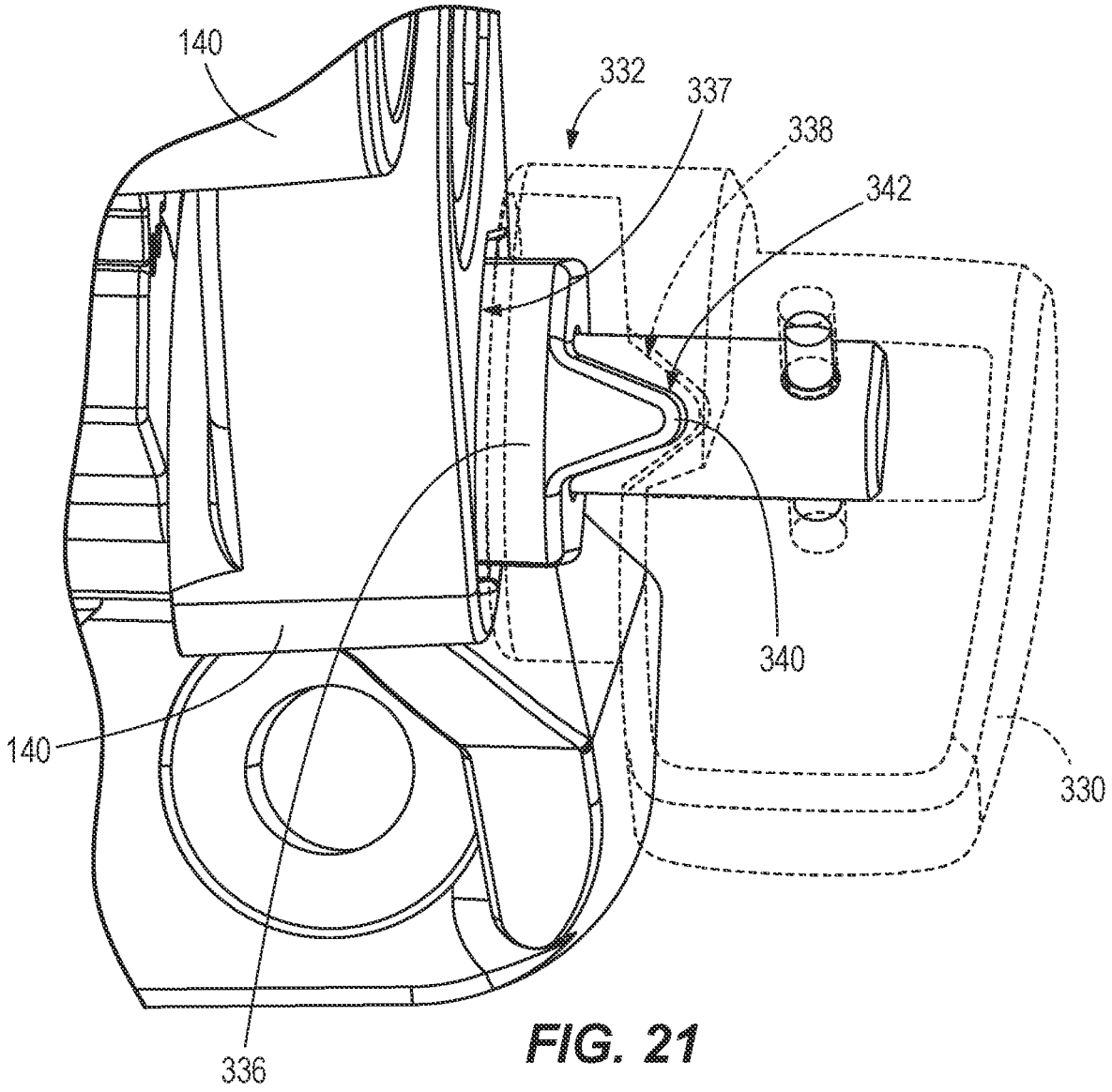
FIG. 21 is a view of one of the tilt levers shown in phantom and the cam device therein.

Referring to FIGS. 17 and 18, the tiller 100 also has a tilt mechanism 300, which advantageously facilitates selective retainment of the tiller arm 104 in any one of a range of user-selectable tilt positions relative to the tilt axis 299 on the base bracket assembly 102. FIG. 17 illustrates via arrows a range of selectable tilt positions of the tiller arm 104 facilitated by the tilt mechanism 300, including in solid line a horizontal tilt position and in phantom lines a vertical straight upward position and in phantom lines a vertical straight downward position, thus spanning a range of selectable positions that extends through 180 degrees relative to the tilt axis 299 on the base bracket assembly 102. FIG. 18 illustrates the tiller arm 104 in solid lines in the horizontal tilt position and in phantom lines additional upward tilt positions which are in fifteen degree increments relative to each other. As further described herein below, the tilt mechanism 300 advantageously allows the user to move and lock the tiller arm 104 in the illustrated range of tilt positions, including in some examples where the tiller arm 104 is movable at least forty-five degrees downwardly from horizontal, further including in some examples at least seventy-five degrees downwardly from horizontal, and further including in some examples at least ninety degrees downwardly relative to horizontal. As will be further described herein below, the tilt mechanism 300 is engageable to retain the tiller arm 104 in any one of a variety of selected positions. As will be further described herein below, the tilt mechanism 300 is further engageable to lock the tiller arm 104 in the uppermost or lowermost positions.

Referring to FIGS. 11 and 24-30, the tilt mechanism 300 includes a tilt bracket 302 which is fastened to the inner end 200 of the tiller arm 104. The tilt bracket 302 has an inner arm 304 which extends into the interior of the tiller arm 104 defined by the chassis 212 and cover 214. The inner arm 304 is fixed via fasteners 307 extending through the chassis 212 and into engagement with the inner arm 304. The tilt bracket 302 extends from the inner end 200 of the tiller arm 104 and has a body 308. A through-bore 311 extending laterally through the body 308. Ratchet wheels 310 are located on laterally opposite sides of the body 308, each having a series of two-sided angular ratchet recesses 312 located along the outer radius of the rear side of the respective ratchet wheel 310. Upper and lower pairs of locking arms 314, 315 are located axially between the ratchet wheels 306 and radially extend from the body 308 on opposite sides of the series of ratchet recesses 312, respectively. Each of the upper and lower pairs of locking arms 314, 315 provide sidewalls for a respective rectangular-shaped locking recess 316, 317 having a bottom wall and opposing side walls extending upwardly from the bottom wall.

Referring to FIGS. 3 and 6, the tilt mechanism 300 also includes a tilt shaft 320 which extends along a tilt shaft axis 299 and is rotatably supported within the opposed through-bores 142 in the arms 140. A pawl 324 is pinned to the middle of the tilt shaft 320, axially between the arms 140. The pawl 324 is rotatable along with the tilt shaft 320 about the tilt shaft axis 299 and relative to the base bracket assembly 102. The pawl 324 has opposing ratchet surfaces 326 having a series of pointed ratchet protrusions for mating in a meshed engagement with the ratchet recesses 312 on the ratchet wheels 306, as will be further described herein below. The pawl 324 also has a locking bar 328 located axially between the ratchet surfaces 326.

Figure 22:
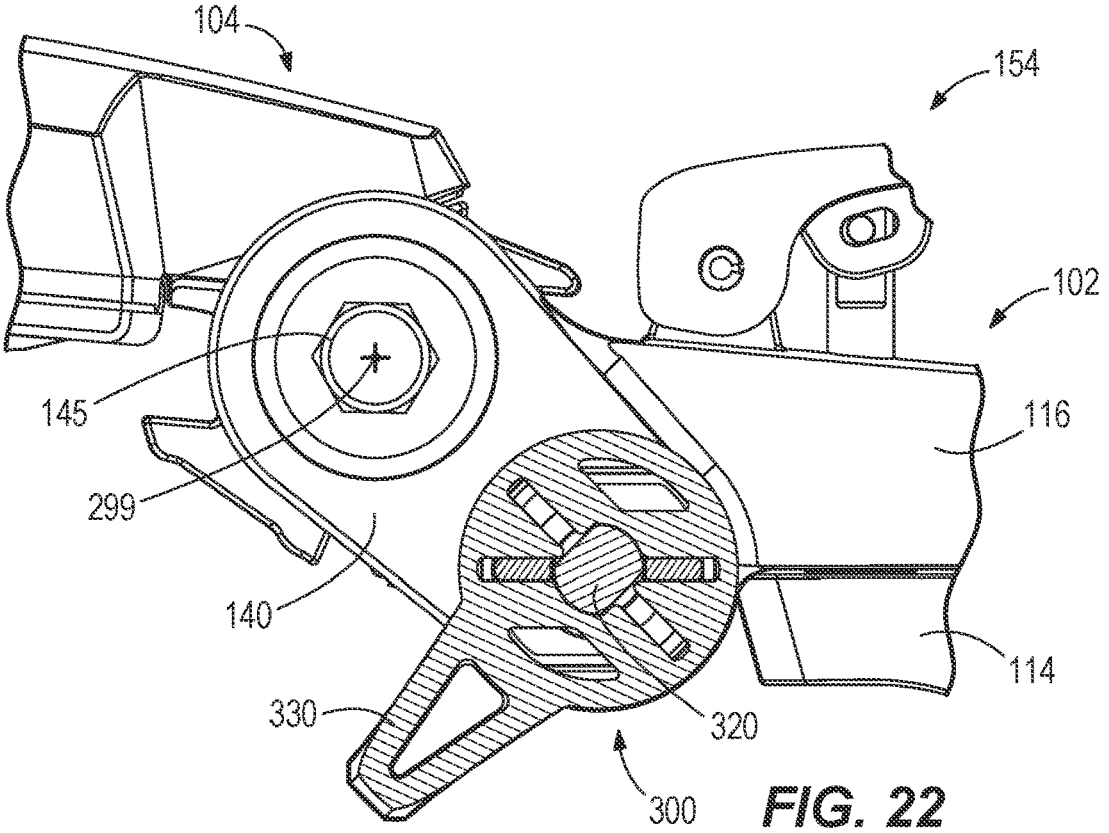
FIG. 22 is a side view illustrating the tilt shaft, tilt lever and cam device of the tilt mechanism in a disengaged position.
Figure 23:
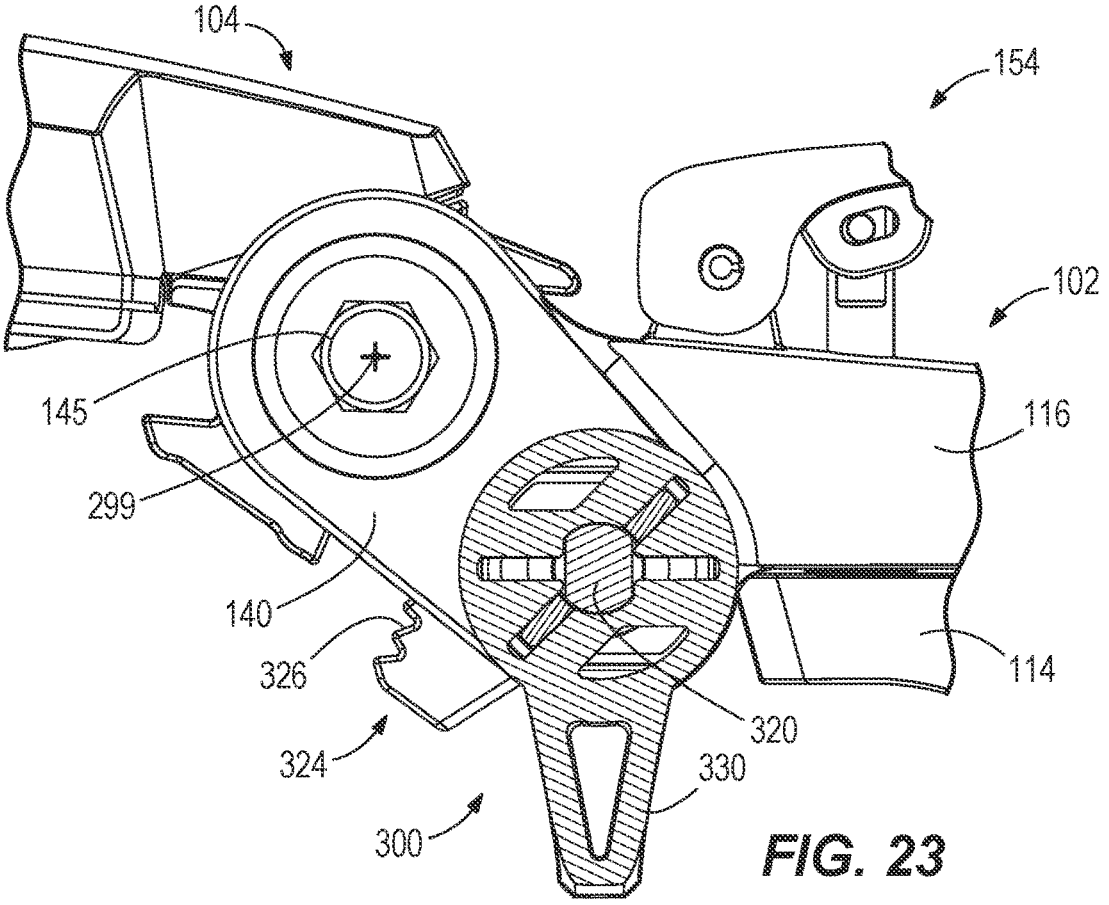
FIG. 23 is a view like FIG. 20 illustrating the tilt mechanism in an engaged position.

Referring to FIG. 6 and FIGS. 19-21, the tilt mechanism 300 further includes tilt levers 330 fastened to each end of the tilt shaft 320. The tilt levers 330 are manually rotatable, which causes rotation of the tilt shaft 320 and pawl 324 about the tilt shaft axis 299 and with respect to the arms 140. A novel cam device 332 is located on one end of the tilt shaft 320. The cam device 332 includes a coil spring 334 disposed on the tilt shaft 320, a cam body 336 on the tilt shaft 320 and a cam receiver 338 formed on the inside surface of the respective tilt lever 330. The spring 334 and cam body 336 are located in a bore 337 in the respective arm 140 such that the cam body 336 remains rotatably fixed relative to the arm 140 but can axially travel with respect to the tilt shaft 320. The coil spring 334 provides a spring bias force that biases the cam body 336 axially outwardly towards the cam receiver 338 in the tilt lever 330. The cam body 336 has axially outwardly facing rounded ridges 340 which are configured to alternately nest in correspondingly contoured surfaces 342 in the cam receiver 338 depending on a rotational position of the tilt lever 330, as will be further described herein below. Generally speaking, the contoured surfaces 342 in the cam receiver 338 provide a first elongated pocket for nesting the rounded ridges 340 of the cam body 336 when the tilt mechanism 300 is in the disengaged position (see FIG. 22), and a second elongated pocket for nesting the rounded ridges 340 when the tilt mechanism 300 is in the disengaged position (see FIG. 23). As further described herein below, moving the cam device 332 from one of the disengaged position and engaged position to the other of the disengaged position and engaged position requires application of a rotational force on the cam device 332 that is greater than a cam force provided by the spring 334 plus camming engagement between the rounded ridges 340 and contoured surfaces 342 in the nested orientation of the cam body 336 in the cam receiver 338. The rotational force can be applied by manually rotating the tilt levers 330 or by rotating the tiller arm 104 upwardly into the vertical straight upward position shown in FIG. 17. This causes the contoured surfaces 342 to cammingly engage the rounded ridges 340, which in turn causes the cam body 336 to axially travel inwardly away from the cam receiver 338 along the tilt shaft 320 in the bore 337, against the bias of the spring 334, until the contoured surfaces 342 are removed from the existing pocket in which it resides, which permits further rotation of the tilt levers 330 and corresponding rotation of the tilt shaft 320 and pawl 324 to the other of the disengaged and engaged position, whereafter the spring 334 biases the cam receiver 338 back axially outwardly into engagement with the new pocket. In the illustrated example, the cam device 332 is located on one end of the tilt shaft 320, however in other examples, the tilt mechanism 300 includes cam devices 332 on both ends of the tilt shaft 320. Also, in other examples the orientation of the levers 330 can be flipped 180 degrees to better avoid interference of components.

Figure 24:
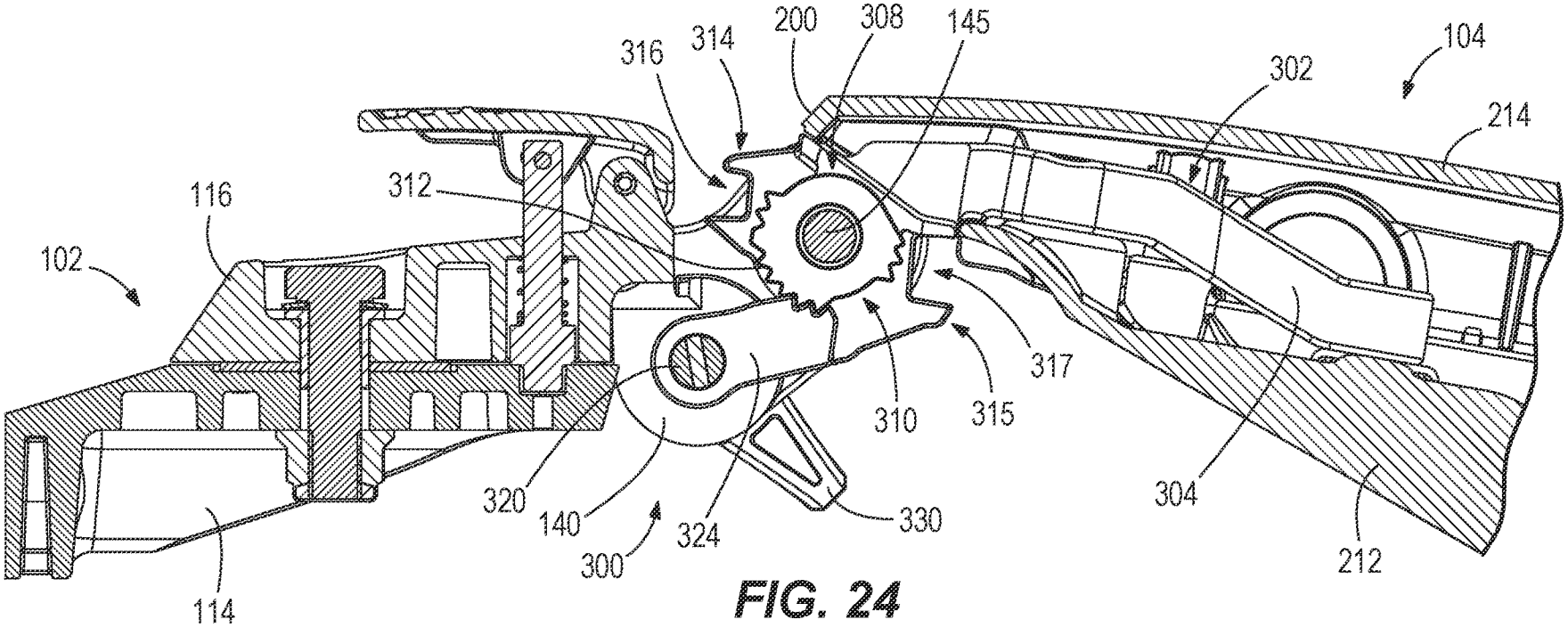
FIG. 24 is a side sectional view illustrating the tilt mechanism in the engaged position with the tiller arm in a tilt position that is slightly downward from horizontal.

FIG. 24 is a side sectional view illustrating the tilt mechanism 300 in an engaged position with the tiller arm 104 in a tilt position that is angled slightly downward from horizontal. The tilt mechanism 300 is illustrated in the engaged position, wherein the spring 334 is biasing the pawl 324 in the counter-clockwise direction in the side perspective of FIG. 24, and such that the opposing ratchet surfaces 326 on the pawl 324 are mated with the first few ratchet recesses 312 on the ratchet wheels 306, respectively. As such, the tiller arm 104 is retained in the illustrated tilt position via engagement between the pawl 324 and the body 308 of the tilt bracket 302.

Figure 25:
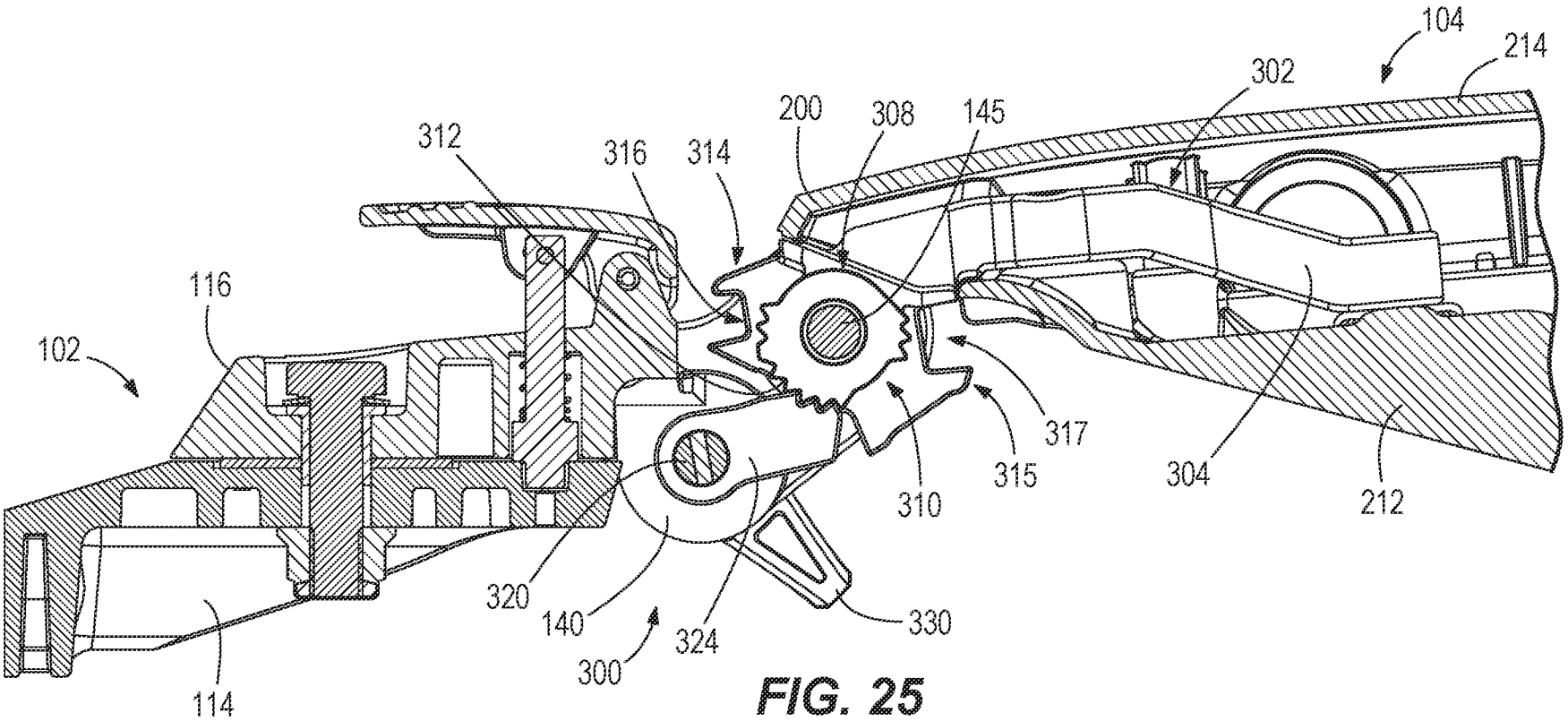
FIG. 25 is a side sectional view illustrating the tilt mechanism in the engaged position with the tiller arm in a horizontal tilt position.

FIG. 25 illustrates the tilt mechanism after a user manually pivots the tiller arm 104 upwardly about the tilt axis 299 defined by the fastener 145, counter-clockwise in the side perspective of FIG. 24. The tilt mechanism 300 remains in the engaged position and the tiller arm 104 is shown in a generally horizontal position relative to the tilt axis 299 and the base bracket assembly 102. Upward pivoting of the tiller arm 104 is permitted by the tilt mechanism 300 via spring-biased ratcheting movement of the pawl 324 along the ratchet wheels 306, particularly as the ratchet surfaces 326 on the pawl 324 ratchet along the ratchet recesses 312 of the ratchet wheels 310, respectively, until the tiller arm 104 is brought to a rest position, which permits the spring 334 to rotate the pawl 324 towards the tilt bracket 302, causing meshed engagement between the ratchet surfaces 326 and ratchet recesses 312. The spring bias is provided by the axial bias of spring 334, pushing the cam body 336 axially into engagement with the cam receiver 338 such that the rounded ridges 340 tend to remain nested in the pocket corresponding to the locked position. As the tiller arm 104 is rotated upwardly, the ratchet surfaces 326 move along the ratchet surfaces 326, which causes slight counter-clockwise and clockwise movements of the pawl 324 and tilt shaft 320 about the tilt shaft axis 299. Such movements of the pawl 324 and tilt shaft 320 is facilitated by the counter-acting forces provided by the cam device 332. In particular, slight clockwise rotation of the pawl 324 and tilt shaft 320 is facilitated by camming engagement of the rounded ridges 340 upwardly along the contoured surfaces 342 of the respective pocket. Slight clockwise (return) rotation is cause by the bias of the spring 334, pushing the cam body 336 axially towards the cam receiver 338, which causes the rounded ridges 340 to cam back down along the contoured surfaces 342 into a fully nested position. Compared to the downwardly angled position shown in FIG. 24, more of the ratchet surfaces 326 are engaged with ratchet recesses 312 on the ratchet wheels 310.

Figure 26:
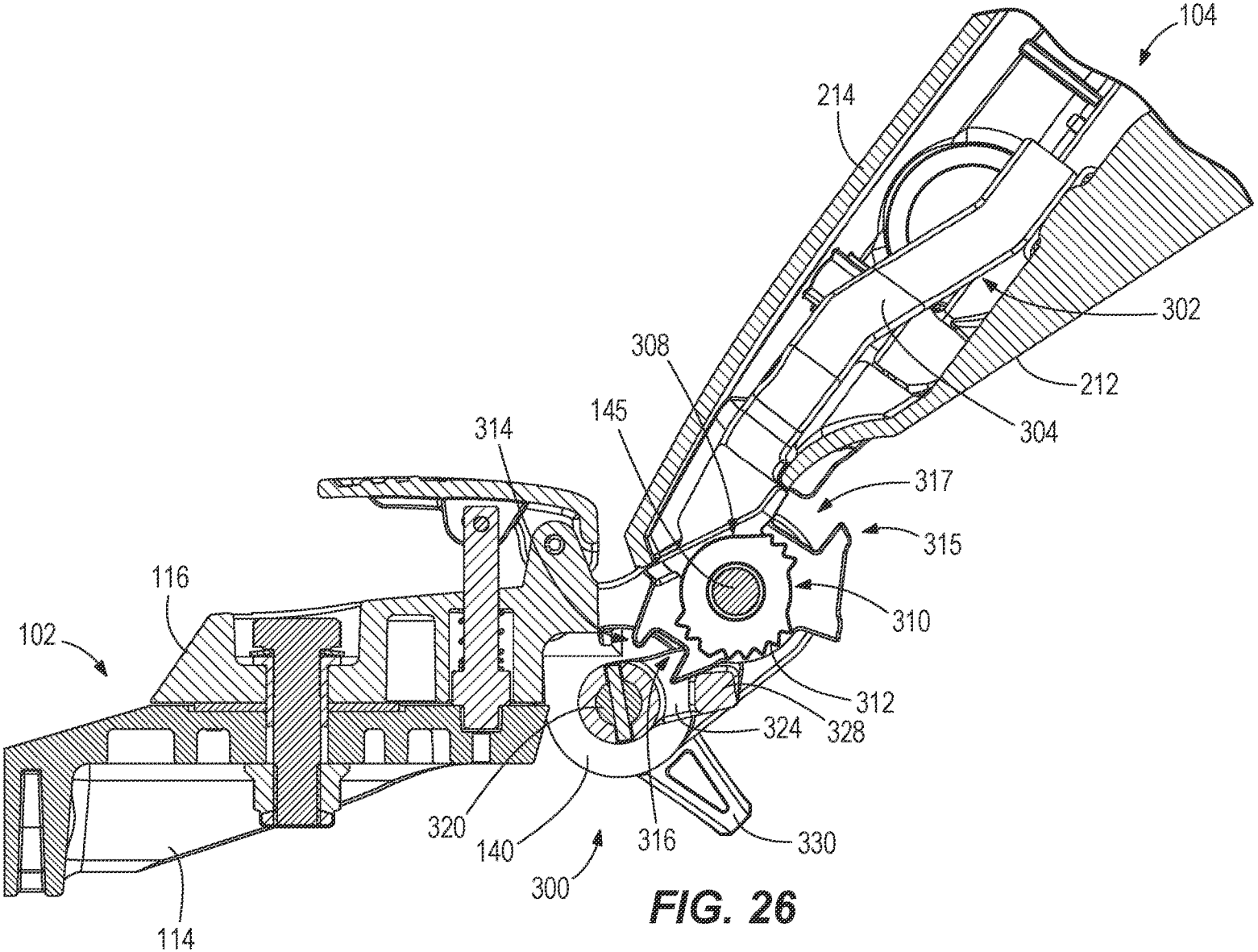
FIG. 26 is a side sectional view illustrating the tiller arm as it is pivoted upwardly towards the uppermost, vertically straight up tilt position and illustrating a tilt bracket of the tilt mechanism as it engages a pawl of the tilt mechanism in such a way that moves the tilt mechanism into the disengaged position by overcoming a cam force provided by the cam device.
Figure 27:
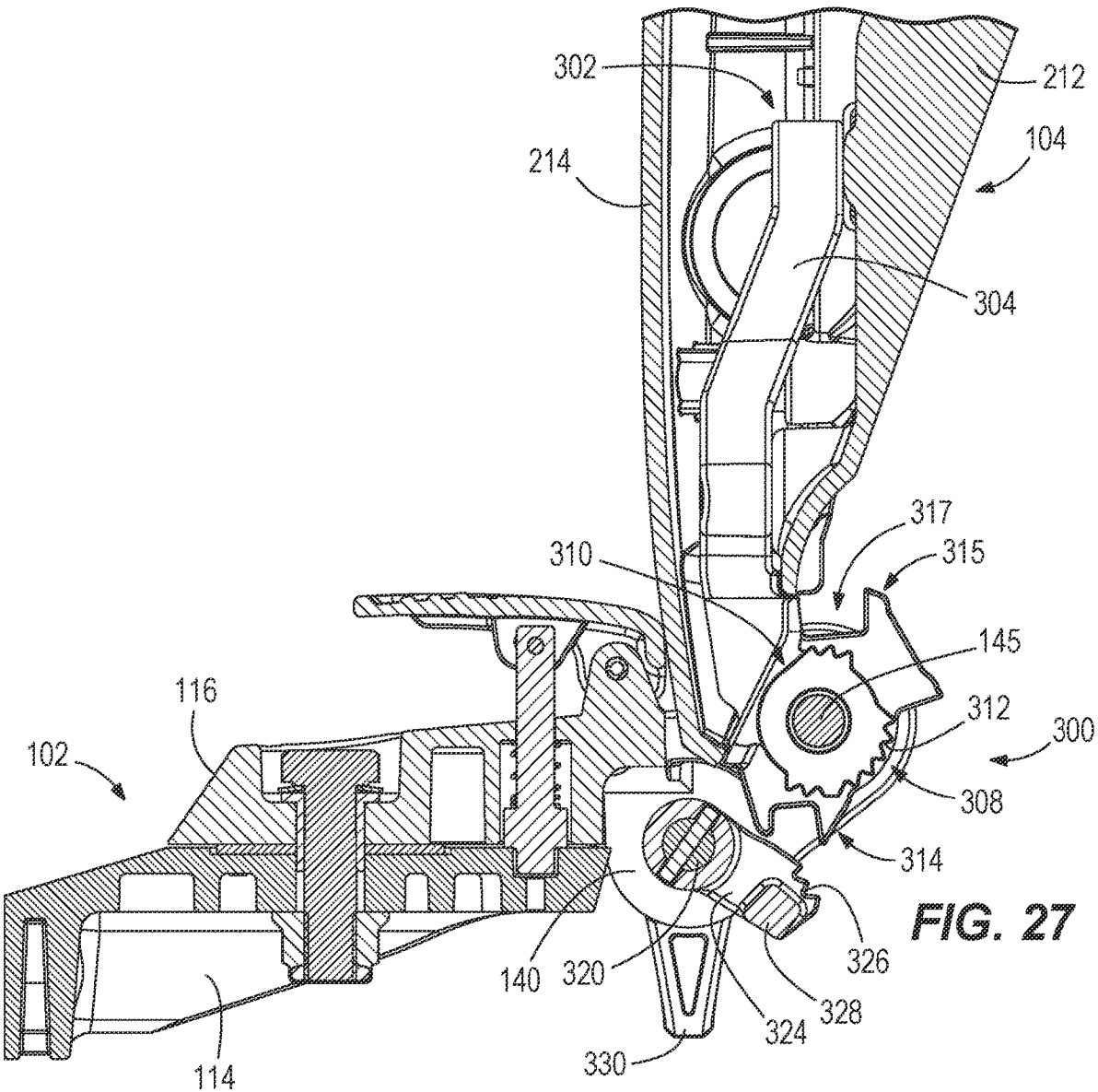
FIG. 27 is a side sectional view illustrating the tilt mechanism in the disengaged position and the tiller arm in the uppermost, vertically straight up tilt position.

FIG. 26 illustrates the tiller arm 104 as it is manually pivoted further upwardly relative to the tilt axis 299, further counter-clockwise in the side perspective of FIG. 26. Such upward pivoting of the tiller arm 104 relative to the tilt axis 299 brings the outside edge of the upper locking arms 314 into engagement with the upper surface of the locking bar 328 on the pawl 324, as shown. When the tiller arm 104 is further rotated upwardly from the position shown in FIG. 26, with a rotational force that is greater than the above-noted cam force provided by the cam device 332, the outside edge of the upper locking arms 314 forces the pawl 324 to rotate downwardly, clockwise in the side perspective of FIG. 26. More specifically, the rotational force applied on the pawl 324 and tilt shaft 320 rotates the cam receiver 338 relative to the cam body 336, which causes the rounded ridges 340 of the cam body 336 to travel upwardly along the contoured surfaces 342 of the cam receiver 338, against the bias of the spring 334, until the rounded ridges 340 fully leave the noted pocket corresponding to the engaged position and become aligned with and nested in the noted pocket corresponding to the disengaged position. This simultaneously causes the tilt shaft 320 and tilt levers 330 to also rotate downwardly until the pawl 324 is rotated out of the way of the tilt bracket 302, as shown in FIG. 27. Thus manually pivoting of the tiller arm 104 upwardly into the position shown in FIG. 27 automatically frees the tiller arm 104 to be pivoted back downwardly to any angle.

Figure 28:
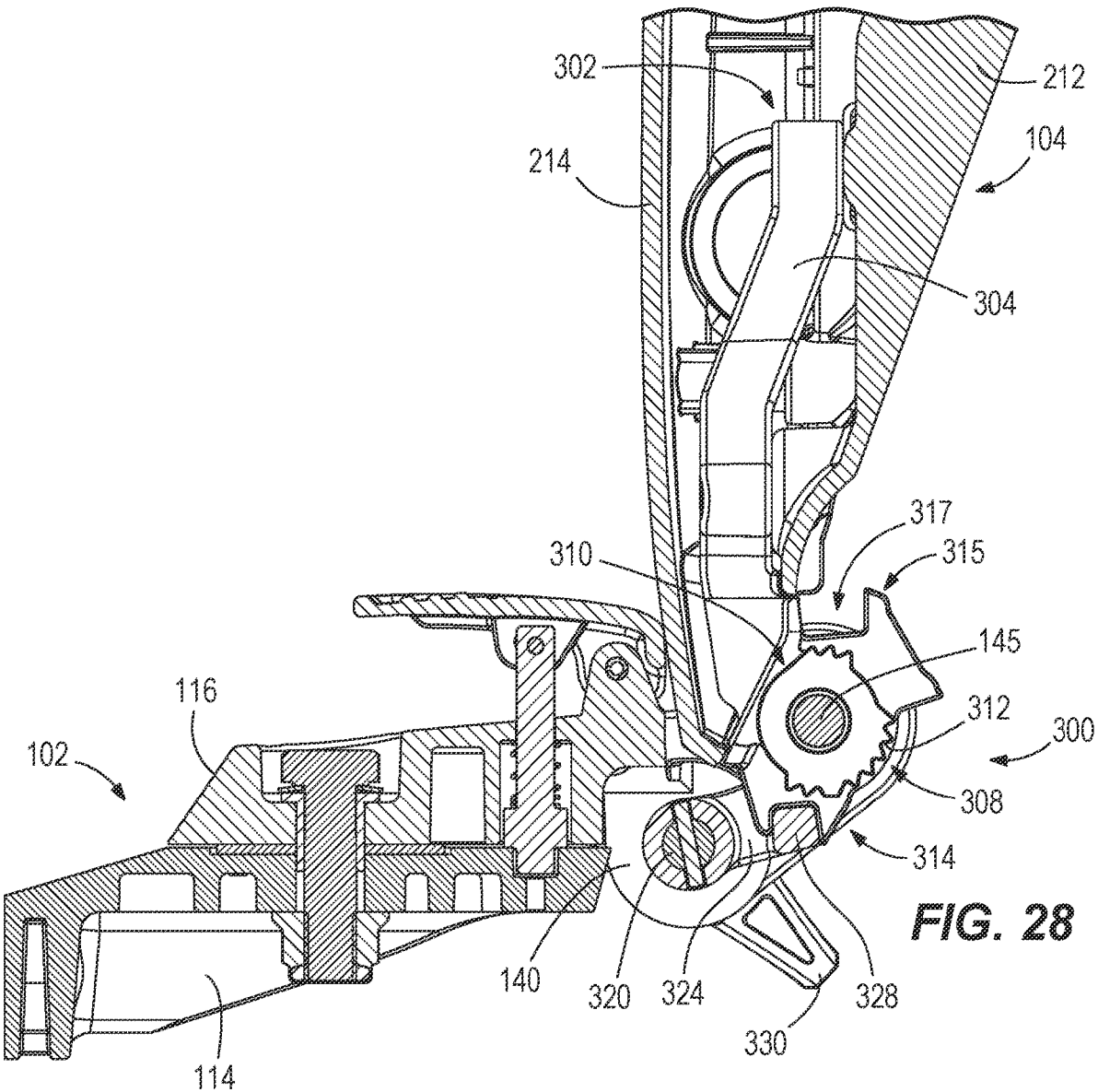
FIG. 28 is a side sectional view illustrating the tilt mechanism in the engaged position and the tiller arm in the uppermost, vertically straight up tilt position.

As shown in FIG. 28, if the user wants to lock the tiller arm 104 in the vertical upward position, the user manually rotates one or both of the tilt levers 330 with a force that is greater than the cam force provided by the cam device 332. This overcomes the bias of the spring 334 and the nested surfaces of the cam body 336 and cam receiver 338 and rotates the locking bar 328 of the pawl 324 into locking engagement with the recess 316 provided by the upper locking arms 314, effectively locking the tiller arm 104 in place.

Figure 29:
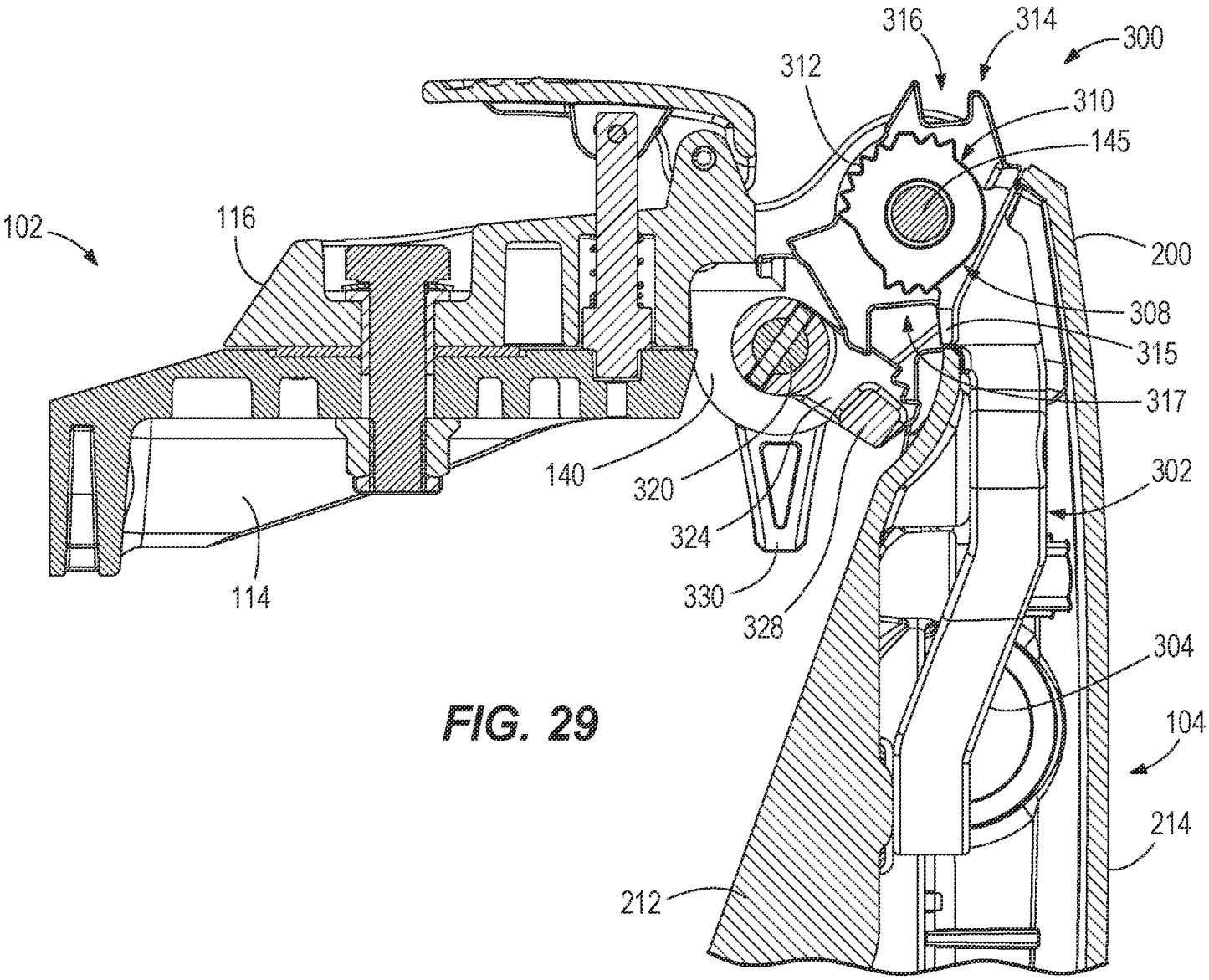
FIG. 29 is a side sectional view illustrating the tilt mechanism in the disengaged position and the tiller arm in the lowermost, vertically straight down tilt position.
Figure 30:
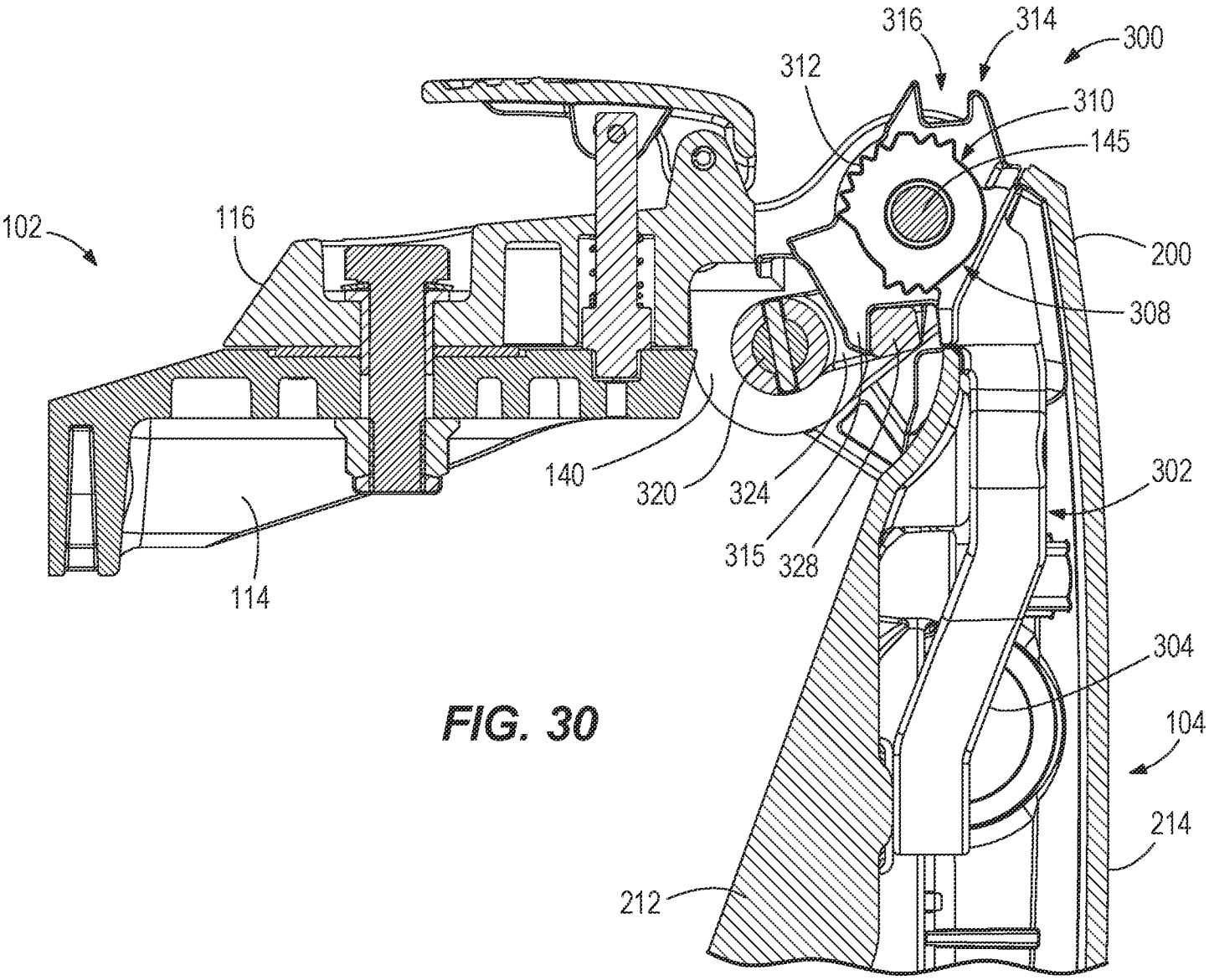
FIG. 30 is a side sectional view illustrating the tilt mechanism in the engaged position with the tiller arm in a vertically straight down tilt position.
Figure 31:
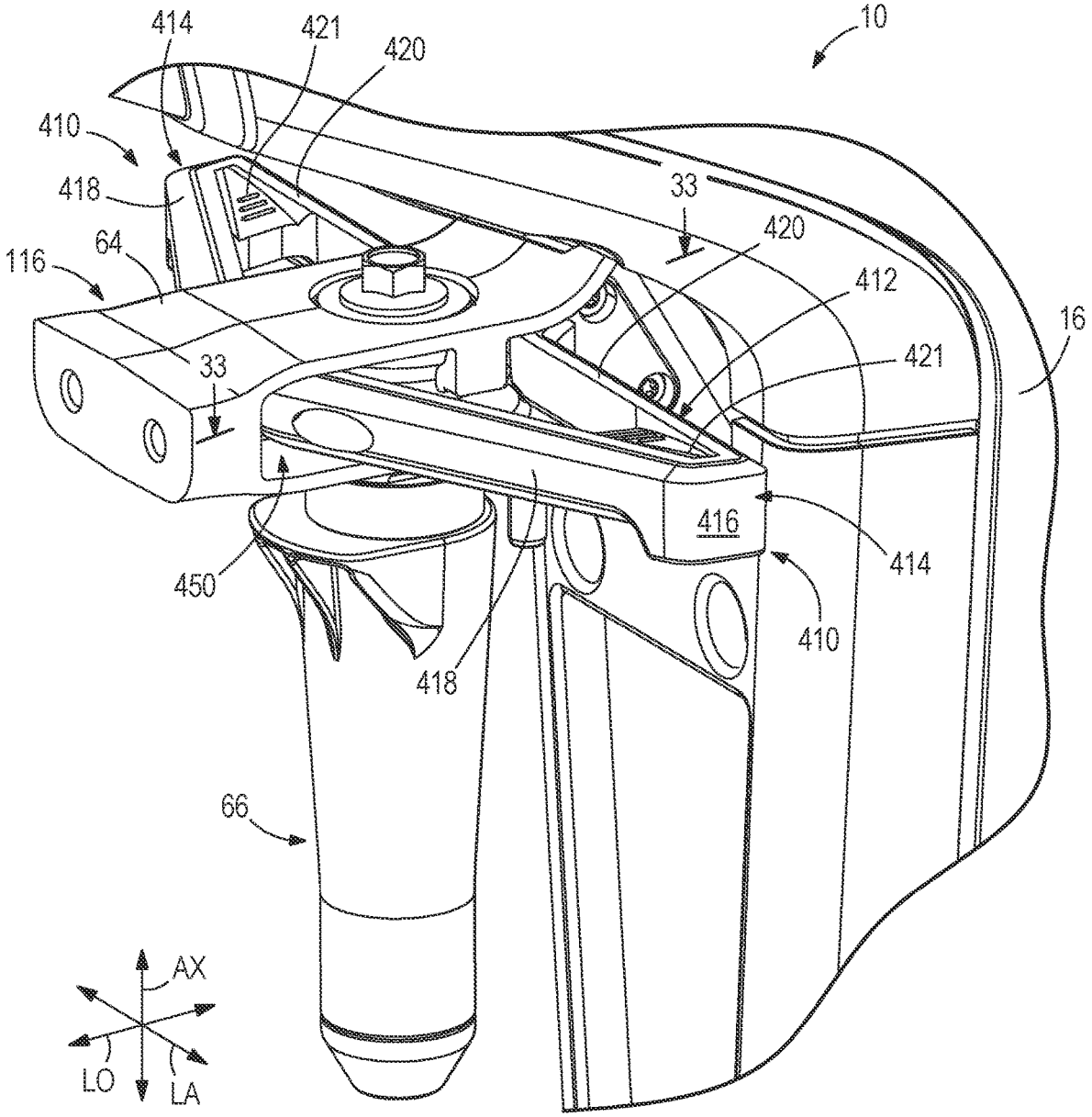
FIG. 31 is a perspective view of a steering arm extending forwardly from a midsection of the outboard motor and wings extending laterally from the steering arm.

As shown in FIGS. 29-30, if the user wants to unlock the tiller arm 104 and move it downwardly, for example to the vertically straight downward position shown, the user manually rotates one or both of the tilt levers 330 with a force that is greater than the noted cam force. This rotates the locking bar 328 of the pawl 324 downwardly, clockwise in the side view of FIGS. 29-30. This removes the locking bar 328 from the recess 316 and frees the tilt bracket 302 from the pawl 324 and permits the user to manually lower the tiller arm 104 about the tilt axis 299 into the vertically straight downward position shown. Thereafter the user can again rotate the tilt levers 330 counter-clockwise, which brings the locking bar 328 of the pawl 324 into locking engagement with the recess 317 defined by the lower locking arms 315. This effectively locks the tiller arm 104 in place with a robust tilt mechanism which can be made strong enough to permit a user to carry the associated marine drive via the tiller arm 104 in the position shown in FIG. 30.

During research and development, the present inventors realized it would be desirable to configure a marine drive, for example an outboard motor, in such a way that it can be conveniently lifted from its position on a marine vessel, or from a side or rear laydown position, transported to another location, and then safely set back down on the ground or other supporting surface without causing damage to the cowling other fragile components of the marine drive.

FIGS. 31-34 depict an embodiment of an outboard motor 10. The outboard motor 10 extends from top to bottom in an axial direction AX, from side to side in a lateral direction LA which is perpendicular to the axial direction AX, and from front to rear in a longitudinal direction LO which is perpendicular to the axial direction AX and perpendicular to the lateral direction LA. Like the embodiments described herein above, the outboard motor 10 has a cowling 16 and a gearcase 14 (see FIG. 34), which is located below the cowling 16. The outboard motor 10 also has the extension leg 18 extending axially below the cowling 16 and located axially above gearcase 14. A midsection 417 of the outboard motor 10 is located between the top and bottom of the outboard motor 10. In particular, the lower portions of the cowling 16 and the extension leg 18 constitute the midsection 417 (see FIG. 37) of the outboard motor 10, which is located axially between the upper portions of the cowling 16 and the gearcase 14. A steering bracket 116 having a steering arm 64 extends forwardly from the midsection 417. As described herein above regarding the embodiments shown in FIGS. 1-30, the first end of the steering arm 64 is rigidly fastened to a supporting frame or other supporting component of the outboard motor 10. The opposite, second end of the steering arm 64 is fixed to a conventional tiller 100. As described herein above, the type and configuration of the tiller 100 can vary from what is shown and described. In the illustrated example, the tiller 100 is pivotable into and between a use position (FIG. 1) for steering of the outboard motor 10 and a storage position (FIG. 2) for manual transport of the outboard motor 10, as will be further described herein below, wherein the tiller 100 extends generally parallel to the steering tube 66.

As shown in FIGS. 31-34, first and second wings 410 extend from laterally opposite sides of the outboard motor 10, laterally from opposite sides of the steering arm 64. The wings 410 are located rearwardly of the noted tiller 100 and transom bracket assembly 30 with respect to the longitudinal direction LO, and forwardly of the noted midsection 417 of the outboard motor 10. Each wing 410 has a frame 412 with an inner end fastened to the steering arm 64 and an outer end providing a footing 414. The footing 414 has a laterally outer, planar surface 416 for supporting the outboard motor 10 in a side laydown position, as will be further described herein below with reference to FIG. 37. Each wing 410 also has first and second arms 418, 420 which extend laterally outwardly from the steering arm 64 to the footing 414. The first and second arms 418, 420 extend at an acute angle $\alpha$ to each other, such that the frame 412 has a triangular shape when viewed from above, see FIG. 33, with the footing 414 located at the apex of the triangular shape, adjacent to the acute angle $\alpha$. Together, the first and second arms 418, 420 are configured to distribute the weight of the outboard motor 10 when the outboard motor 10 is in the noted side laydown position, as will be described herein below with reference to FIG. 37. A ribbed gripping surface 421 is located at the apex of the triangular shape. The ribbed gripping surface 421 facilitates easier manually grasping of the respective wing 410 during movement and/or transport of the outboard motor 10.

Figure 32:
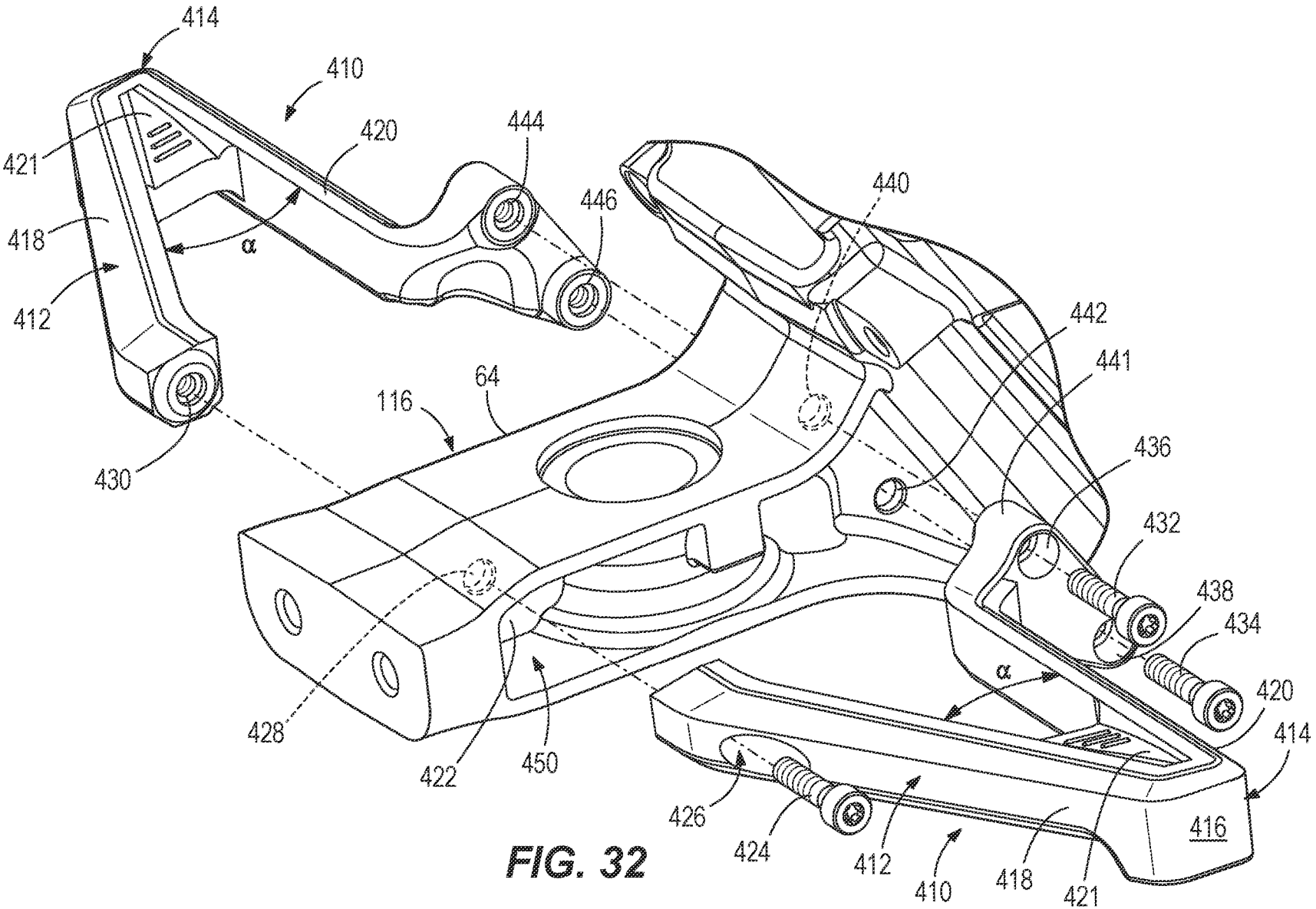
FIG. 32 is an exploded view of the steering arm and wings.
Figure 33:
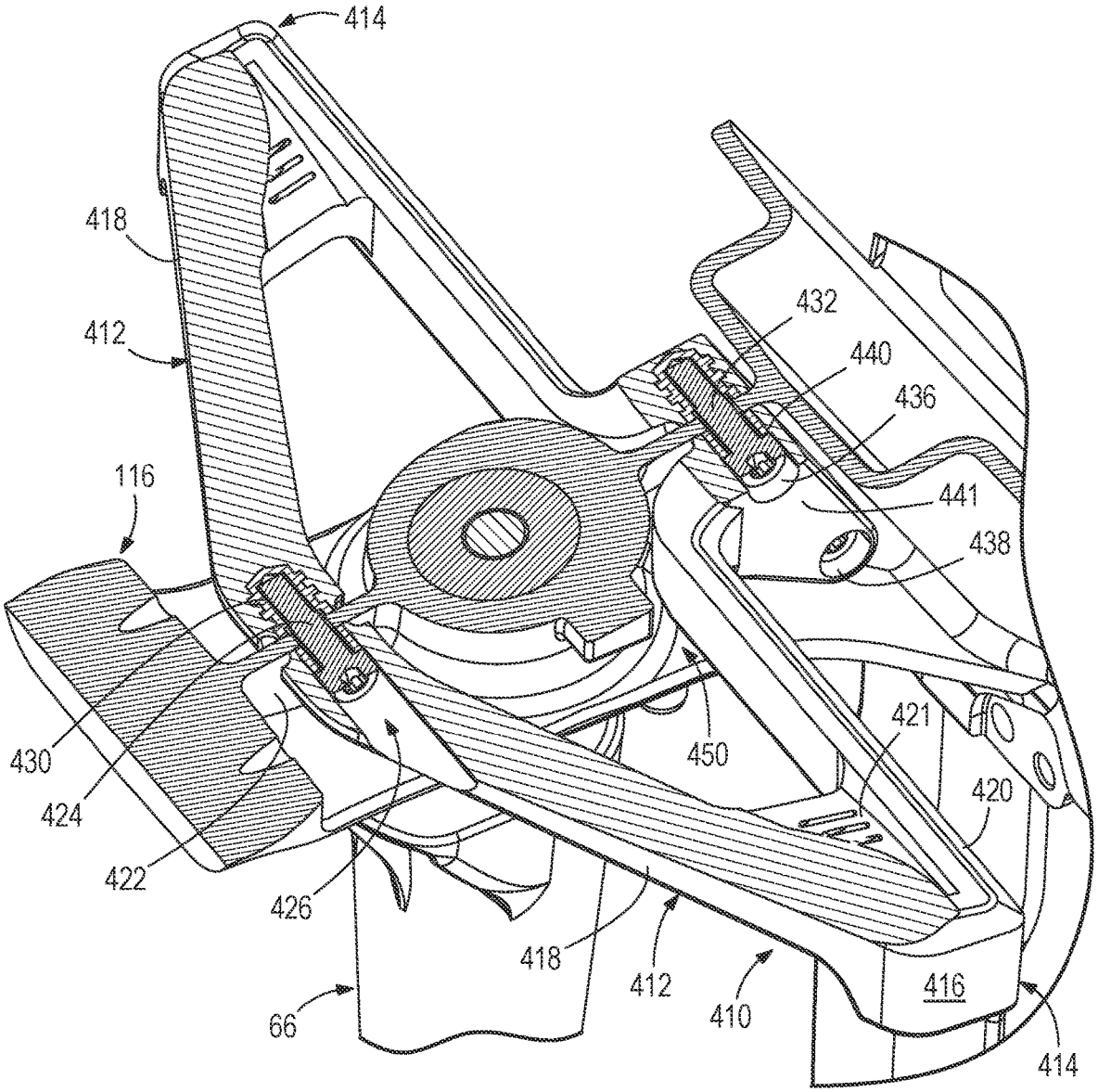
FIG. 33 is a view of section 33-33, taken in FIG. 31.

At the inner end of the frame 412, each of the first and second arms 418, 420 are fastened to a center wall 422 of the steering arm 64 and also to the other wing 410. More specifically, as shown in FIG. 32, a front fastener 424 extends through a sunken bore 426 in the first arm 418 of the first wing 410, through a hole 428 in the center wall 422 and into threaded engagement with a counter bore 430 in the first arm 418 of the second wing 410. Similarly, rear fasteners 432, 434 extend through sunken bores 436, 438 in an end flange 441 on the second arm 420 of the second wing 410, through holes 440, 442 in the center wall 422 and into threaded engagement with counter bores 444, 446 in the first arm 418 of the second wing 410. As shown, the wings 410 extend on opposite sides of the steering tube 66, with the first arm 418 located forwardly of the steering tube 66 and the second arm 420 located rearwardly of the steering tube 66. The inner ends of the frames 412 are disposed in recesses 450 located on opposite sides of the steering arm 64, in particular defined by the space between the center wall 422 and top and 3s 452, 454 of the steering arm 64.

As best shown in FIGS. 34-38, the cowling 16 has an angular outer profile and includes a top cowl surface portion 460 which is generally planar and extends upwardly from front to rear relative to the longitudinal direction LO. Optionally, in the illustrated example, the top cowl surface portion 460 includes a trap door 462 providing access to the powerhead compartment within the cowling 16. The cowling 16 also includes an angular backbone having an upper rear cowl surface portion 466 which extends downwardly and rearwardly from the top cowl surface portion 460, and a lower rear cowl surface portion 468 which extends downwardly and forwardly from the top cowl surface portion 460. A top apex portion 470 is defined at the transition between the top cowl surface and the upper rear cowl surface portion 466. A rear apex portion 472 is defined at the transition between the upper rear cowl surface portion 466 and the lower rear cowl surface portion 468. The cowling 16 also has opposing (first and second) lateral cowl side portion 476 located on opposite sides of the top cowl surface portion 460, the upper rear cowl surface portion 466 and the lower rear cowl surface portion 468. Each lateral cowl side portion 476 has a front side cowl portion 478 and a rear side cowl portion 480. The front and rear side cowl portions 478, 480 are joined by a laterally raised transition rib 482 which extends along the entire height of the cowling 16, from the top cowl surface portion 460 to the extension leg 18. When viewed from the side, the raised transition rib 482 extends generally downwardly and rearwardly from the top cowl surface portion 460 to a side apex portion 484 located along the noted midsection 417 of the outboard motor 10, and then further downwardly and generally forwardly to the extension leg 18. The front side cowl portion 478 extends laterally outwardly from its front side to the raised transition rib 482. The rear side cowl portion 480 extends laterally outwardly from its rear side to the raised transition rib 482.

Figure 35:
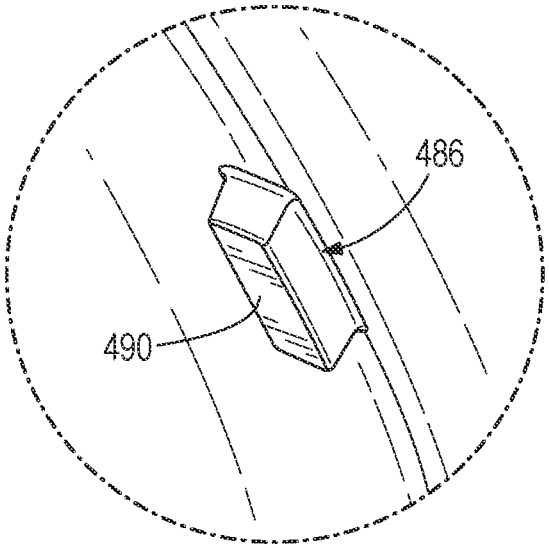
FIG. 35 is a detailed view taken in FIG. 34.
Figure 37:
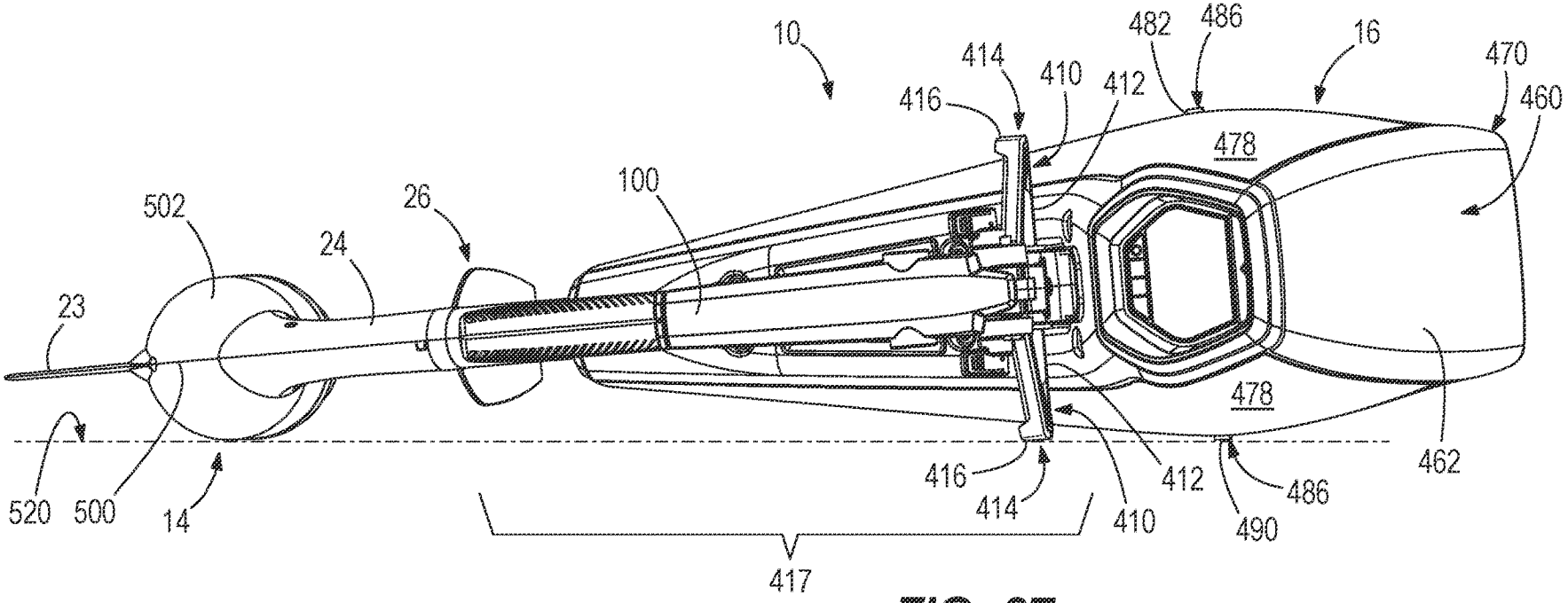
FIG. 37 is a front view showing the outboard motor in a side laydown position.

Referring to FIGS. 35 and 37, a first support members 486 is located on each of the lateral cowl side portions 476, along the raised transition rib 482, proximate to the side apex portion 484. In the illustrated embodiment, each first support member 486 is a thickened portion of the sidewall of the cowling 16 (i.e., having an increased thickness compared to the surrounding portions of the cowling 16), which thus has an increased rigidity compared to the surrounding portions of the cowling 16, in particular such that the support member 486 is suitable for supporting the weight of the outboard motor 10 in a side laydown position, as will be further described herein below regarding FIG. 37. The first support member 486 has a planar laterally outer surface 490 for abutting the ground or other supporting surface on which the outboard motor 10 is placed.

Figure 36:
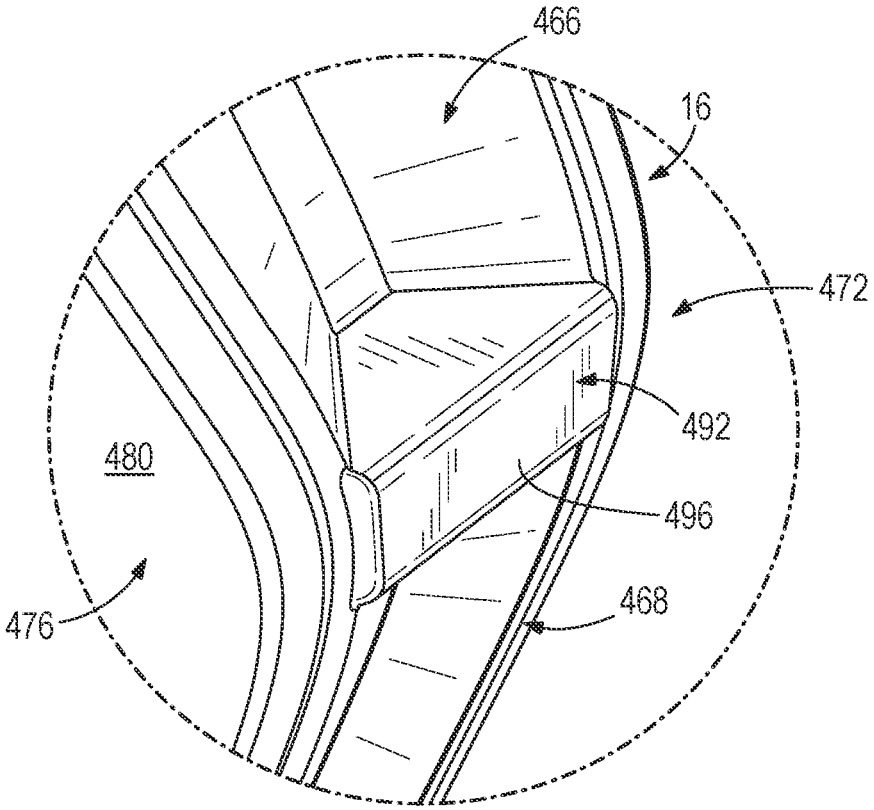
FIG. 36 is a detailed view taken in FIG. 34.
Figure 38:
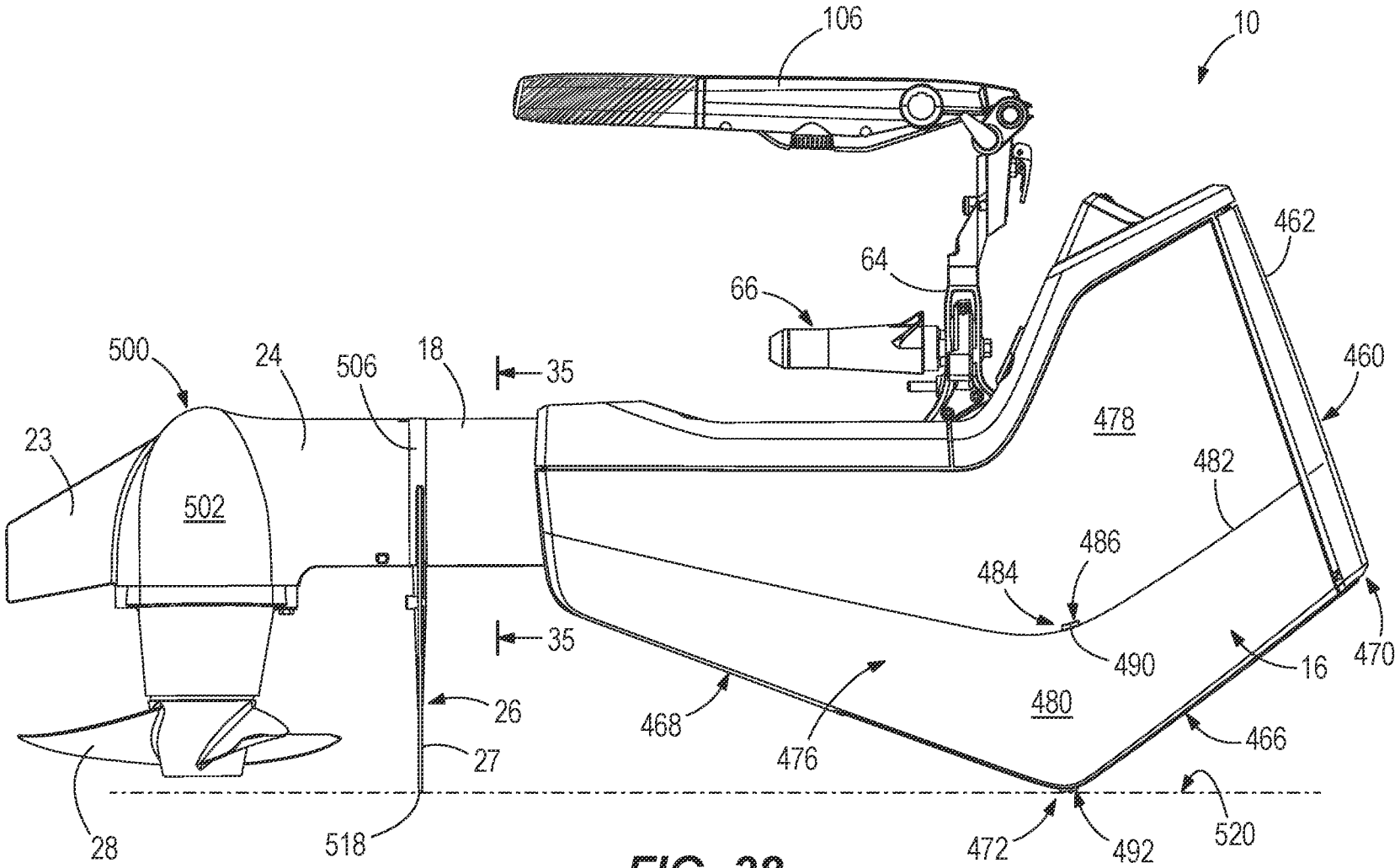
FIG. 38 is a side view showing the outboard motor in a rear laydown position.

Referring to FIGS. 36 and 38, a second support member 492 is located on the rear apex portion 472 of the cowling 16. The second support member 492 comprises a laterally elongated rib 494 having a planar rear surface 496 for abutting the ground or other supporting surface on which the outboard motor 10 is placed.

Figure 39:
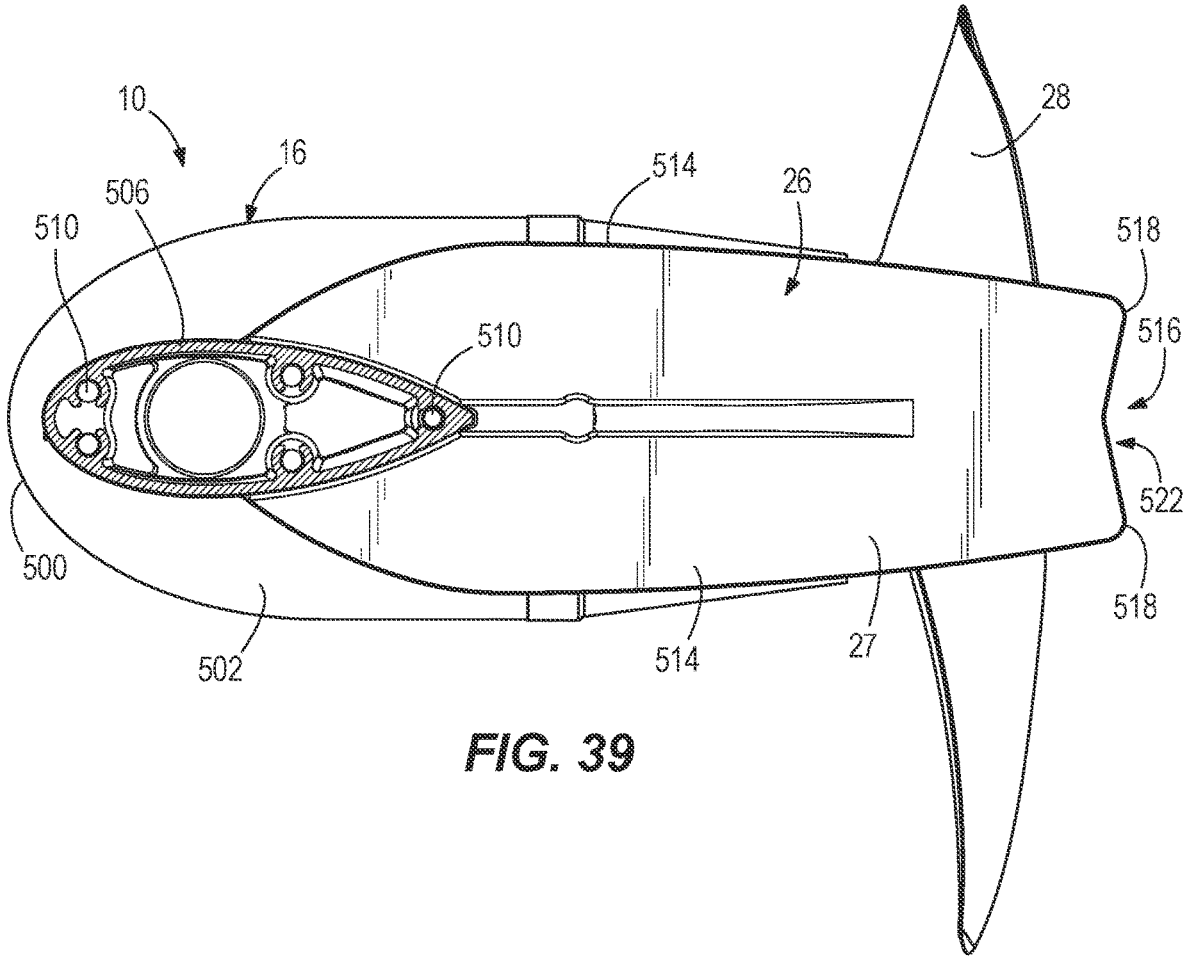
FIG. 39 is a view of section 39-39, taken in FIG. 38.
Figure 40:
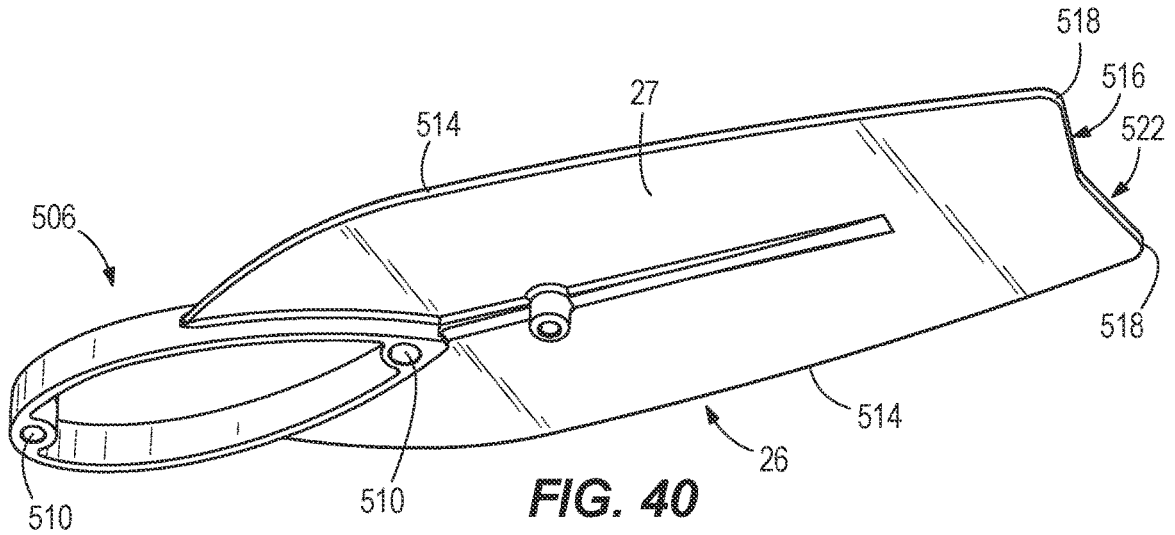
FIG. 40 is a perspective view looking up at an anti-ventilation plate of the outboard motor.

Referring to FIGS. 34 and 37-40, the gearcase 14 has a torpedo housing which is bullet-shaped, having a nose cone 500 which transitions outwardly from front to rear to a body portion 502 having a generally cylindrical outer diameter. As shown in FIGS. 39-40, an anti-ventilation plate 26 is located below the midsection 417. In particular, the illustrated anti-ventilation plate 26 is located axially between the gearcase 14 and extension leg 18. The anti-ventilation plate 26 has a head portion 506 that mounted to the lower portion of the extension leg 18 and to the upper portion of the gearcase 14 by fasteners (not shown) extending through holes 510 in the head portion 506 and into engagement with one or both of the gearcase 14 and the stem 24 of the gearcase 14. The anti-ventilation plate 26 also has a tail portion 27, which is an elongated plate extending rearwardly from the head portion 506 and the outboard motor 10. The anti-ventilation plate 26 has laterally-outwardly curved sides 514 and a rear edge 516. The rear edge 516 has a spaced apart pair of laterally outer rear support members 518, which as described further herein below with reference to FIG. 38 support the outboard motor 10 in a rear laydown position. As shown in FIG. 39, the rear edge 516 has a V-shape with a valley 522, wherein the laterally rear support members 518 are the outermost edges of the V-shape of the tail portion 27 on opposite sides of the valley 522.

FIG. 37 depicts the outboard motor 10 in a side laydown position on a support surface 520. As shown, the outboard motor 10 is fully supported on the support surface 520 by a side tripod consisting of the outer, planar surface 416 of the footing 414 of the wing 410, the support member 486 on the lateral cowl side portion 476 of the cowling 16 that faces the support surface 520, and the lateral side of the gearcase 14 facing the support surface 520, particularly along the outer diameter of its body portion 502. It should be understood that FIG. 37 depicts the outboard motor 10 in one of two opposing side laydown positions, wherein only one of the wings 410 is configured to form the side tripod with the support member 486 and lateral side of the gearcase in one of the side laydown positions. In the depicted position, the opposing wing 410 along ribbed gripping surface 421 provides a convenient location to manually grasp and move the outboard motor 10. In addition or alternately, the tiller arm 104 and/or steering tube 66 provide convenient locations for grasping and lifting of the outboard motor 10.

FIG. 38 depicts the outboard motor 10 in a rear laydown position on the support surface 520. As shown, the outboard motor 10 is fully supported above the support on the support surface 520 by a rear tripod consisting of the planar rear surface 496 of the support member 492 on the rear apex portion 472 of the cowling 16 and the rear support members 518 on the tail portion 27 of the anti-ventilation plate 26. In this orientation, the tiller arm 104 and/or steering tube 66 provide convenient locations for grasping and lifting the outboard motor 10. In addition or alternately, either or both wings 410 can be manually grasped so as to lift the outboard motor 10.

Some non-limiting embodiments of an outboard motor may be configured as a transportable outboard motor 10 including a tiller 100 including a tilt mechanism 300 (see FIGS. 3-30) and laydown capabilities (see FIGS. 31-40). For example, FIGS. 1, 2, 34, 37, and 38 illustrate an embodiment of an outboard motor 10 including a tiller 100 that facilitates manual carrying of the outboard motor 10, and which includes features providing a tripod for supporting the outboard motor in a side laydown position (see FIG. 37) and/or a rear laydown position (see FIG. 38).

The transportable outboard motor 10 includes a tiller 100 extending forwardly from the midsection 417. While the tiller 100 is in a straight-forward position, as illustrated in FIG. 1, the tiller 100 is generally parallel to the steering arm 64. The tiller 100 is coupled to the steering arm 64 and is pivotable about a lateral tilt axis 299 into a downward tilt position in which the tiller 100 is oriented transversely to the lateral and longitudinal directions, as illustrated in FIG. 2. In the illustrated embodiments, the tiller 100 is perpendicular to the lateral and longitudinal directions while in the downward tilt position. Other embodiments, however, may include a tiller configured to be retained in a different orientation while in the downward tilt position.

The rotation of the tiller 100 is selectively controlled by a tilt mechanism 300, which is movable into an engaged position in which the tiller 100 is locked in the downward tilt position and a disengaged position in which the tiller 100 is movable out of the downward tilt position. As discussed in reference to FIGS. 3-30, the tilt mechanism 300 includes a tilt bracket 302 that is coupled to a first one of the midsection 417 and/or steering arm 64 of the transportable outboard motor 10 and the tiller 100 and a pawl 324 coupled to a second one of the midsection 417 and/or steering arm 64 of the transportable outboard motor 10 and the tiller 100. When the tilt mechanism 300 is moved into the engaged position, the pawl 324 engages the tilt bracket 302 to retain the tiller 100 in the downward tilt position. When the tilt mechanism 300 is moved into the disengaged position, the pawl 324 is disengaged from the tilt bracket 302 so that that the tiller 100 is freely movable about the tilt axis 299 relative to the midsection 417 and the steering arm 64.

The tilt bracket 302 includes a ratchet wheel 310 having an outer radius with a recess 317 corresponding to the downward tilt position. The pawl 324 is coupled to the midsection 417 (or alternatively to the steering arm 64 or tiller 100) by a tilt shaft 320, which defines the lateral tilt shaft axis 299 about which the pawl is pivotable into the engaged position and the disengaged position. A spring or other biasing device biases the pawl 324 into contact with the ratchet wheel 310 such that the pawl 324 ratchets across the ratchet wheel 310 and engages with the recess 317 when the tiller 100 is pivoted downwardly about the lateral tilt axis 299. The recess 317 comprises a bottom wall and opposing sidewalls which engage with an end wall and sidewalls of the pawl 324, respectively, to securely lock the tiller 100 in the downward tilt position. Additionally, the pawl 324 is coupled to a cam device 322 which provides a cam force retaining the tilt mechanism 300 in the engaged position and alternately retaining the tilt mechanism 300 in the disengaged position.

While in the downward tilt position, the tiller 100 facilitates manual carrying of the transportable outboard motor 10. This may be particularly useful, for example, to pick up the outboard motor 10 from the rear laydown position, or to set the outboard motor 10 down in the rear laydown position. As discussed in reference to FIGS. 31-40, the anti-ventilation plate 26, together with the cowling 16, supports the transportable outboard motor 10 above a ground surface in a rear laydown position. The anti-ventilation plate 26 includes a rear edge 516 with laterally outer rear support members 518 spaced apart by a valley 522. The cowling 16 includes a support member 392 at the apex portion 472 of the rear of the cowling 16 and upper and lower cowl surface portions 466, 468 which extend transversely away from the apex portion 472. Together, the rear support members 518 and the rear of the cowling 16 form a rear tripod which supports the transportable outboard motor 10 in the rear laydown position. As illustrated in FIG. 38, the tiller 100, which is in the downward tilt position, is oriented above the outboard motor 10 and acts as a lift point for carrying the outboard motor 10.

Additionally or alternatively, some embodiments of a transportable outboard motor 10 may include other features configure for carrying the outboard motor 10. For Example, referring to FIG. 38, the outboard motor 10 includes a steering tube 66 that is coupled to the steering arm 64. The steering tube 66 is oriented such that it is generally parallel to axial direction and the tiller 100 in the downward tilt position. Thus, the steering tube 66 may act as a lift point thereby facilitating manual carrying of the transportable outboard motor.

It will thus be understood by one having ordinary skill in the art that the present disclosure provides improved outboard motor configurations that are easily and safely lifted, transported and then placed on the ground or on another supporting surface in a manner that reduces the chances of the outboard motor being damaged in the process. In use, a person can manually pivot the tiller arm into the storage position shown in FIGS. 37 and 38. The person can manually grasp the tiller arm and/or the steering tube and lift the outboard motor off the ground. After the person is done carrying the outboard motor, it can be safely set down in one of the side laydown positions or in the rear laydown position, wherein the outboard motor is safely supported by one of the side tripods or the rear tripod described above, such that the likelihood of damage to the more delicate portions of the outboard motor is advantageously reduced.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A transportable outboard motor comprising:

a tiller that is pivotable relative to the transportable outboard motor into a series of tilt positions and downwardly from the series of tilt positions into a downward tilt position; and a tilt mechanism configured to retain the tiller in each of the series of tilt positions so that the tiller is prevented from pivoting downwardly relative to the transportable outboard motor but is permitted to pivot upwardly relative to the transportable outboard motor, wherein the tilt mechanism is further configured to lock the tiller in the downward tilt position so that the tiller is prevented from pivoting upwardly or downwardly relative to the transportable outboard motor, and wherein locking the tiller in the downward tilt position facilitates carrying of the transportable outboard motor via the tiller.

2. The transportable outboard motor according to claim 1, further comprising a cowling and an anti-ventilation plate which together with a rear portion of the cowling supports a remainder of the transportable outboard motor above a ground surface in a rear laydown position.

3. The transportable outboard motor according to claim 1, wherein the tilt mechanism includes a pawl and a tilt bracket, the tilt bracket including a series of ratchet recesses that are engaged by the pawl to retain the tiller in the series of tilt positions and a locking recess that is engaged by the pawl to lock the tiller in the downward tilt position.

4. The transportable outboard motor according to claim 3, wherein disengaging the pawl from the locking recess and pivoting the tiller upwardly from the downward tilt position causes the pawl to ratchet across the series of ratchet recesses.

5. The transportable outboard motor according to claim 3, wherein the pawl is spring biased into engagement with the series of ratchet recesses.

6. The transportable outboard motor according to claim 3, wherein the locking recess includes opposing sidewalls that engage opposite sides of the pawl to lock the tiller in the downward tilt position.

7. The transportable outboard motor according to claim 3, wherein the pawl is pivotable into and out of engagement with the locking recess.

8. The transportable outboard motor according to claim 3, further comprising a lever configured to move the pawl into and out of engagement with the locking recess.

9. The transportable outboard motor according to claim 3, wherein the pawl includes ratchet surfaces configured to engage the series of ratchet recesses and a locking bar configured to engage the locking recess.

10. The transportable outboard motor according to claim 3, further comprising a spring-loaded cam device configured to retain the pawl in an engaged position relative to tilt bracket and alternately in a disengaged position relative to the tilt bracket.

11. A transportable outboard motor comprising:

a cowling;

an anti-ventilation plate having outer rear support members which together with a rear portion of the cowling form a rear tripod configured to support a remainder of the transportable outboard motor above a ground surface in a rear laydown position;

a tiller that is pivotable relative to the transportable outboard motor into a downward tilt position; and a tilt mechanism configured to lock the tiller in the downward tilt position so that the tiller is prevented from pivoting upwardly or downwardly relative to the transportable outboard motor and such that the transportable outboard motor may be lifted out of the rear laydown position via the tiller.

12. The transportable outboard motor according to claim 11, wherein the rear portion of the cowling includes an apex portion which together with the outer rear support members forms the rear tripod.

13. The transportable outboard motor according to claim 11, further comprising a steering arm extending from the transportable outboard motor and steering tube extending from the steering arm, wherein the tiller in the downward tilt position extends generally parallel to the steering tube so that the transportable outboard motor may be lifted out of the rear laydown position via either or both of the tiller and the steering tube.

14. The transportable outboard motor according to claim 13, wherein the steering tube is configured to be received in and rotate relative to a transom bracket assembly to facilitate steering of the transportable outboard motor relative to the transom bracket assembly.

15. A transportable outboard motor comprising:

a midsection;

a steering arm extending forwardly from the midsection;

a tiller coupled to the steering arm, the tiller being pivotable relative to the steering arm into a downward tilt position in which the tiller is oriented generally transversely to the steering arm; and a steering tube coupled to the steering arm and located between the tiller and the midsection, wherein the tiller in the downward tilt position extends generally parallel to the steering tube so that the transportable outboard motor may be carried by either or both of the steering tube and the tiller in the downward tilt position.

16. The transportable outboard motor according to claim 15, wherein the steering tube is configured to be received in and rotate relative to a transom bracket assembly to facilitate steering of the transportable outboard motor relative to the transom bracket assembly.

17. The transportable outboard motor according to claim 15, wherein the transportable outboard motor extends from top to bottom in an axial direction, from side to side in a lateral direction perpendicular to the axial direction, and from front to rear in a longitudinal direction perpendicular to the axial direction and perpendicular to the lateral direction, and wherein the steering tube and the tiller in the downward tilt position are both laterally centered relative to the transportable outboard motor.

18. The transportable outboard motor according to claim 17, wherein the tiller in the downward tilt position is longitudinally forward of the steering tube.

19. The transportable outboard motor according to claim 15, further comprising a tilt mechanism that is movable into an engaged position in which the tiller is locked in the downward tilt position and a disengaged position in which the tiller is movable out of the downward tilt position.

20. The transportable outboard motor according to claim 15, further comprising a cowling and an anti-ventilation plate which together with a rear of the cowling supports a remainder of the transportable outboard motor above a ground surface in a rear laydown position, wherein the transportable outboard motor may be lifted out of the rear laydown position via either or both of the steering tube and the tiller in the downward tilt position.

* * * * *